US006481819B2

(12) United States Patent
Kaneko et al.

(10) Patent No.: US 6,481,819 B2
(45) Date of Patent: Nov. 19, 2002

(54) INK JET RECORDING HEAD AND RECORDING APPARATUS HAVING RECORDING ELEMENT SUBSTRATES WITH DIFFERENT LIQUID EJECTION SYSTEMS

(75) Inventors: Mineo Kaneko, Tokyo (JP); Ken Tsuchii, Sagamihara (JP); Keiichiro Tsukuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,196

(22) Filed: Jul. 10, 2001

(65) Prior Publication Data

US 2002/0041310 A1 Apr. 11, 2002

(30) Foreign Application Priority Data

Jul. 10, 2000 (JP) ..... 2000-209092
Sep. 6, 2000 (JP) ..... 2000-270691

(51) Int. Cl.[7] ..... B41J 2/205
(52) U.S. Cl. ..... 347/15
(58) Field of Search ..... 347/15, 40, 42, 347/43, 62, 65, 47, 45, 67

(56) References Cited

U.S. PATENT DOCUMENTS

| | | | | |
|---|---|---|---|---|
| 4,380,771 A | * | 4/1983 | Takatori | 347/65 |
| 4,463,359 A | * | 7/1984 | Ayata et al. | 347/13 |
| 4,565,859 A | | 1/1986 | Murai et al. | 528/365 |
| 5,172,139 A | | 12/1992 | Sekiya et al. | 347/15 |
| 5,412,410 A | * | 5/1995 | Rezanka | 347/15 |

FOREIGN PATENT DOCUMENTS

| | | | | |
|---|---|---|---|---|
| EP | 0822080 | | 2/1998 | B41J/2/14 |
| JP | 60-161973 | | 8/1985 | C07D/3/14 |
| JP | 63-221121 | | 9/1988 | C08G/59/02 |
| JP | 64-9216 | | 1/1989 | C08G/59/34 |
| JP | 2-140219 | | 5/1990 | C08G/59/18 |
| JP | 8-480035 | * | 6/1996 | B41J/2/14 |

OTHER PUBLICATIONS

J.V. Crivello et al.; Journal of Polymer Science; New Photoinitiators for Cationic Polymerization; No. 56, pp. 383–395 (1976).

Patent Abstracts of Japan; vol. 1996, No. 06; Jun. 28, 1996 & JP 08 048035 A (Canon Inc), Feb. 20, 1996.

Patent Abstracts of Japan; vol. 018, No. 554 (M–1691); Oct. 21, 1994 & JP 06 198914 A ( Fuji Xerox Co Ltd); Jul. 19, 1994.

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet recording head includes a plurality of recording element substrates each having a plurality of recording elements for applying ejection energy to recording liquid; a plurality of flow paths for the recording liquid which is to receive ejection energy; a supply port for supplying the recording liquid to the plurality of flow paths; a plurality of ejection outlets for ejecting the recording liquid, the ejection outlets being disposed face to the recording elements, respectively; wherein distances between the recording elements and the ejection outlets in at least one of the recording element substrates are different from distances between the recording elements and ejection outlets of another one of the recording element substrates, and wherein liquid ejection systems of the recording elements of the at least one of the recording element substrates and the recording elements of the another one of the recording element substrates, are different.

14 Claims, 11 Drawing Sheets

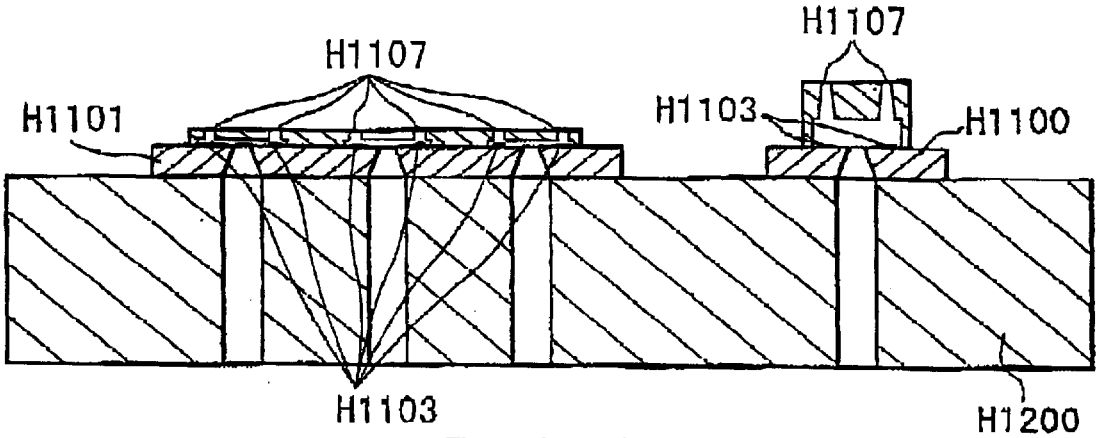
FIG. 9
FIG. 10
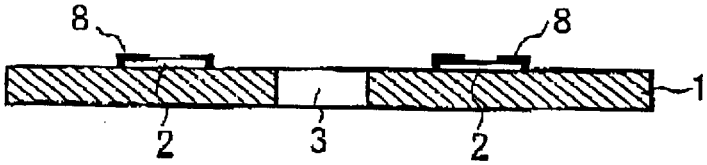
FIG. 11
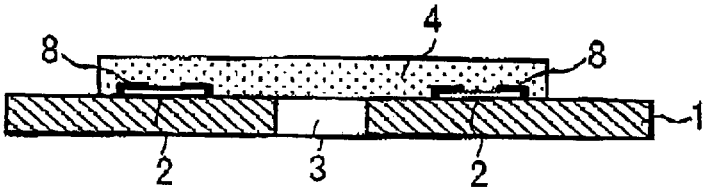
FIG. 12
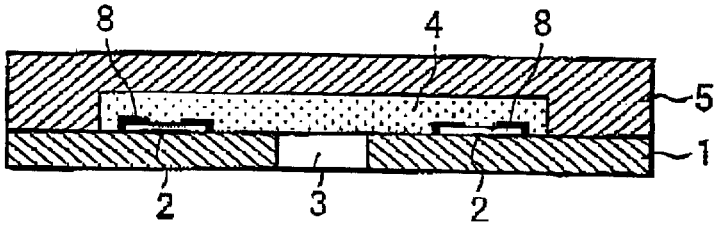
FIG. 13
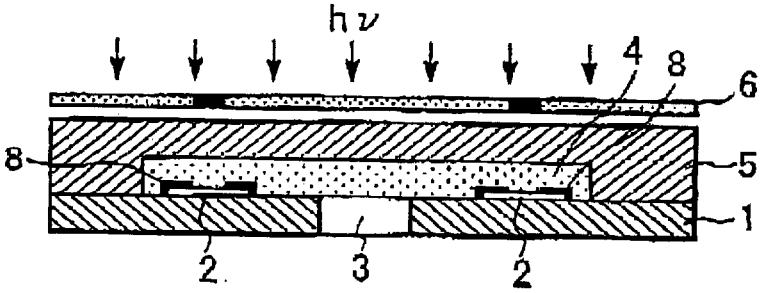

INK JET RECORDING HEAD AND RECORDING APPARATUS HAVING RECORDING ELEMENT SUBSTRATES WITH DIFFERENT LIQUID EJECTION SYSTEMS

FIELD OF THE INVENTION AND RELATED ART

The present invention relate to a recording apparatus which records an image by ejecting recording liquid such as ink, in the form of a droplet, from its ejection orifices. It also relates to an ink jet recording head used for such a recording apparatus. Not only can an ink jet recording head in accordance with the present invention be usable with an ordinary printing apparatus, but also with such an apparatus as a copying machine, a a facsimile machine equipped with a communication system, or a word processor equipped with a printing portion, or an industrial recording apparatus intricately combined with various processing apparatuses. An ink jet recording apparatus is a recording apparatus based on a so-called nonimpact recording method. It is characterized that it is capable of recording on various recording media at a high speed, and makes virtually no noises while recording. Thus, an ink jet recording apparatus is widely used as an apparatus which plays a role of a recording mechanism in a printer, a copy machine, a facsimile machine, or a word processor.

Known as a typical ink ejecting method for a recording head mounted in an ink jet recording apparatus such as the one described above are a method which employs electromechanical transducers such as a piezoelectric element, a method which employs an electromagnetic device such as a laser, a method which employs electrothermal transducers having a heat generating resistor, and the like methods. In a method employing an electromagnetic device, electromagnetic waves are irradiated to generate heat, which is used to eject ink droplets, whereas in a method employing electrothermal transducers, ink is heated with the electrothermal transducers, to a point of film-boiling so that ink droplets are ejected. In an ink jet recording head which employs electrothermal transducers, the electrothermal transducers are disposed within a recording liquid chamber, and electrical pulses as recording signals are supplied to the electrothermal transducers to generate heat to give ink thermal energy. As thermal energy is given to ink, that is, recording liquid, the ink changes in state, generating bubbles therein, and the pressure generated as a bubble grows is used to eject microscopic droplets of ink from microscopic orifices onto recording medium, As a result, an image is formed on the recording medium.

Generally, an ink jet recording head has a plurality of recording nozzles for ejecting ink droplets, and a supply system for supplying the recording nozzles with ink.

A recording apparatus equipped with an ink jet recording head such as the one described above can inexpensively output a high quality image inclusive of both a character and a graphic image.

An ink jet recording apparatus is convenient in that it is inexpensive and is capable of outputting a color print. Therefore, an ink jet recording apparatus, in particular, an ink jet recording apparatus based on a bubble-jet method (which hereinafter will be referred to as BJ method) which employs the liquid ejection principle proposed by Canon Inc., that is, the applicant of the present invention, has been occupying the major portion of the printer market. According to the BJ method, liquid is heated to a point of film-boiling so that liquid is ejected by bubble formation (generation, growth, contraction, and extinction). This type of a printer has a black, cyan, magenta, and yellow ink ejecting head portions, all of which employ a bubble-jet method.

There is a general tendency that the number of the ejection orifices of each head portion is increased to improve image quality: it has been increased from 64 to 128, 256, or the like, which is equivalent to 300, 600, and the like, equivalent to a resolution of 300 dpi, 600 dpi, or the like, or the number of dots per inch: in other words, ejection orifices are disposed at a very high density. Also in each head portion, a plurality of electrothermal transducers as heating elements are disposed in a manner to oppose these ejection orifices. An electrothermal transducer is driven by a pulse, the duration of which is in the order of several microseconds to 10 microseconds, to heat ink to the point of film-boiling to form a bubble in the ink. In other words, it can be driven at a very high frequency to print a high quality image at a high speed. In recent years, there has been a tendency to increase the number of the heating elements to be driven per unit of time, in order to further improve the performance of the head portion.

Recently, a new type of a printer which a employs an air/bubble connection method, that is, the so-called bubble-through-jet method (which hereinafter will be referred to as BTJ method), has been introduced into the market. This bubble-through-jet system is a new type, or an improved type, of the above described bubble-jet system, which also was proposed by the applicant of the present invention. According to this type, the aforementioned bubble is allowed to become integrated with the atmospheric air in order to stabilize liquid a droplet size, so that microscopic liquid droplets uniform in size can be ejected. This type of a printer also has black, cyan, magenta, and yellow liquid ejecting head portions, all of which employ a BTJ methods, as all the ink ejecting head portions of the aforementioned bubble-jet printer employ a bubble-jet method. In other words, this BTJ type printer outputs an image higher in quality than the image outputted by a conventional bubble-jet printer, by ejecting microscopic liquid droplets uniform in size. The advantages of this new printer are as follows.

In order to achieve color recording quality as high as that of silver salt photography, a picture dot must be small enough to be unrecognizable as a dot on recording medium (not large enough to make an image look grainy).

Therefore, the size of a color ink droplet is set to approximately 5 pl (pico-liter or 1012 liter) in volume, 40–50 $\mu$m in diameter, or 600×1,200—1,200—1,200 dpi (dpi is a unit which shows the number of dots per inch) in resolution. In consideration of the fact that the improvement in resolution and sharpness must be also made for a character printed in black ink, it is necessary to form a smaller dot by ejecting a smaller liquid droplet. However, black ink is often used to create a solid image, that is, an area solidly covered with black ink, in addition to recording letters or the like.

If a solid image is printed by ejecting microscopic liquid droplets, the number of times liquid must be ejected becomes rather large, and therefore, recording time tends to become longer. Thus, it is to be desired that the ink droplet size for black ink should be set to a larger one compared to that for color ink, for example, 30 pl in volume, 80 $\mu$m in diameter, or 600 dpi in resolution.

As for the method for differentiating color ink (cyan, magenta, or yellow ink) from black ink, in liquid size or volume, increasing ejection orifice size, and modifying liquid flow path design, have been known. These methods, however, have created new problems in terms of the overall performance of a printer.

That is, the application of a design for forming a microscopic liquid droplet to the aforementioned black, cyan, magenta, and yellow ink ejecting portions which employ the aforementioned BTJ method, results in variance in ejection velocity and liquid droplet volume, tending to make the color ink ejecting portions about the same as, or inferior to, the black ink ejecting portion, in terms of the accuracy with which an ink droplet lands on a predetermined point on recording medium.

On the other hand, the volume of a black ink droplet to be ejected from a recording head comprising black, cyan, magenta, and yellow ink ejection portions which employ the aformentioned BTJ system, can be increased by increasing the size of a heater, of electrothermal transducer, and the size of the ejection orifice. However, this makes it impossible to increase the driving frequency, and therefore, increases the amount of mist created during liquid ejection.

In both cases, it is possible to individually redesign each liquid ejecting portion. However, as the frequency at which the heaters are driven per unit of time when these liquid ejecting portions are in a printer has been gradually increased, the number of the heaters which can be employed has reached a limit, making it impossible to provide a high density recording head which can be efficiently driven. In addition, from the standpoint of realizing an ejection velocity higher than a predetermined level, and also the standpoint of stabilizing liquid droplet size, it has become evident that it is very difficult to realize a printer in which both the black ink ejecting portion and color ink ejecting portions perform at their satisfactory performance levels. As for a printer design for solving the above described problem, it is possible to increase electrical power source capacity or the number of electrical power sources, as is obvious. Such a design, however, makes a printer extremely expensive and large, which is not practical.

Thus, the inventors of the present invention studies the above described problems, and searched for solutions therefor. More specifically, the inventors studied the interaction of the black ink ejecting system and color ink ejecting system, in terms of ejection volume, ejection velocity, and ejection stability, instead of studying them individually. As a result, the inventors discovered that the above described secondary problem which is caused by the solutions to the primary problems, can be solved by making the black ink ejection portion different from the color ink ejection portions, in ejection method itself. Further, in order to reduce the head portion size relative to a printer and to improve the accuracy with which head portions are aligned as they are mounted into a printer, the inventors toiled to simplify the head portion structure, and also to provide a production method compatible with such a structure. As a result, the inventors came up with an idea of placing the black ink ejecting portion and color ink ejecting portion on the same member, and aligning them with reference to a common referential surface.

SUMMARY OF THE INVENTION

Accordingly, a primary object of the present invention is to provided an ink jet recording head and a recording apparatus, which are capable of recording in both black mode and color mode, while accomplishing high density and high quality in both modes, and also are low in cost, small in size, and simple in structure.

According to an aspect of the present invention, there is provided an ink jet recording head comprising a plurality of recording element substrates each having a plurality of recording elements for applying ejection energy to recording liquid; a plurality of flow paths for the recording liquid which is to receive ejection energy; a supply port for supplying the recording liquid to the plurality of flow paths; a plurality of ejection outlets for ejecting the recording liquid, said ejection outlets being disposed face to the recording elements, respectively; wherein distances between the recording elements and the ejection outlets in at least one of said recording element substrates are different from distances between the recording elements and ejection outlets of another one of said recording element substrates, and wherein liquid ejection systems of the recording elements of said at least one of said recording element substrates and the recording elements of said another one of said recording element substrates, are different.

It is preferable that the distances between said recording elements and said ejection outlets in said at least one of said recording element substrates to which blackish liquid is supplied is longer than the distances between said recording elements and said ejection outlets in said another one of said recording element substrates to which chromatic liquid is supplied.

It is preferable that liquid ejection amounts from said ejection outlets in said at least one of said recording element substrates to which blackish liquid is supplied is larger than the liquid ejection amounts from said erection outlets in said another one of said recording element substrates to which chromatic liquid is supplied.

It is preferable that a density of arrangement of said recording elements in said recording element substrates to which the chromatic liquid is supplied is approx. Two times the density of arrangement of said recording elements in said recording elements substrates to which the blackish liquid is supplied. By doing so, the recording elements for the black color and the recording elements for the chromatic color can be actuated at the same frequencies, and therefore, the high-speed printing is accomplished with a simple structure and without degrading the durability.

With such a structure, it is possible that the black droplet may be large so that solid black can be printed at a high speed, while the chromatic color droplet may be small so that high-resolution color printing is accomplished.

It is preferable that the liquid ejection system of the recording elements of said at least one of said recording element substrates is such that bubbles are generated in the recording liquid by actuation of said recording elements, and the bubbles are collapsed, and the liquid ejection system of the recording elements of the recording elements of said another one of said recording element substrates is such that bubbles are generated in the recording liquid by actuation of said recording elements, and the bubbles are brought into communication with ambience.

With the structure, after the color recording liquid is ejected out, the bubble pressure escapes to the outside, and therefore, the vibration of the meniscus is small, so that high speed liquid refilling is accomplished.

It is preferable that said recording element substrates have base plates having substantially the same thicknesses and placed on one flat surface and have ejection outlet forming members laminated on the base plates, and wherein said at least one of said recording element substrates have different heights of the ejection outlet forming member, by which the distances between said recording elements and said ejection outlets are different from the distances between said recording elements and said ejection outlets in said another one of said recording element substrates.

It is preferable that said recording element substrates have base plates having substantially the same thicknesses and placed on one flat surface and have ejection outlet forming members laminated on the base plates, and wherein said ejection outlets are formed by photo-patterning.

It is preferable that the distances between said recording elements and said ejection outlets in said at least one of said recording element substrates are not more than 100 $\mu$m.

It is preferable that a liquid ejection speed VBk and a liquid ejection amount V-dBk through said ejection outlets in said at least one of said recording element substrates, and a liquid ejection speed VCl and a liquid ejection amount V dCl through said ejection outlets in said another one of said recording element substrates, satisfy;

$$vCl>VBk\geqq 8 \text{ m/sec},$$

and $$vdBk>V\ dCl.$$

It is preferable that the distances O HBk between said recording elements and said ejection outlets and distances hBk between said recording elements and said ejection outlet forming member in said at least one of said recording element substrates, and the distances OHCl between said recording elements and said ejection outlets and distances hCl between said recording elements and said ejection outlet forming member in said another one of said recording element substrates, satisfy;

$$hBk>h\ Cl,$$

and $$oHBk>hBk\times 2.$$

It is preferable that there are provided a plurality of ink containers for supplying the recording liquids to said ink jet recording head and to said recording element substrates.

It is preferable that go to sleep and said recording elements are supplied with electric energy from one voltage source.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 8, which comprises

FIG. 9 is an enlarged sectional view of a combination of the recording element chips and first plate in the first embodiment of the present invention.

FIG. 10 is a rough sectional view of the recording element chip before ink flow path and orifice portion are formed on the substrate.

FIG. 11 is a rough sectional view of the recording element chip after the formation of the resolvable ink flow path patterns on the substrate.

FIG. 12 is a sectional view of the recording element chip after the formation of the overcoat resin layer.

FIG. 13 to a sectional view of the recording element chip during the exposure of the overcoat resin layer to the ejection orifice pattern.

FIG. 17, which comprises

PREFERRED EMBODIMENTS OF THE INVENTION

The preferred embodiments of the present invention will be described with reference to the appended drawings.

FIGS. 1–4 are perspective views of a preferable head cartridge, a preferable recording head, and a preferable ink container, in the forms of which the present invention can be embodied, or to which the present invention is preferably applicable. The drawings are for depicting the structures thereof, and the positional relationship among them. Next, their structural components will be described with reference to the drawings.

Figure 1:
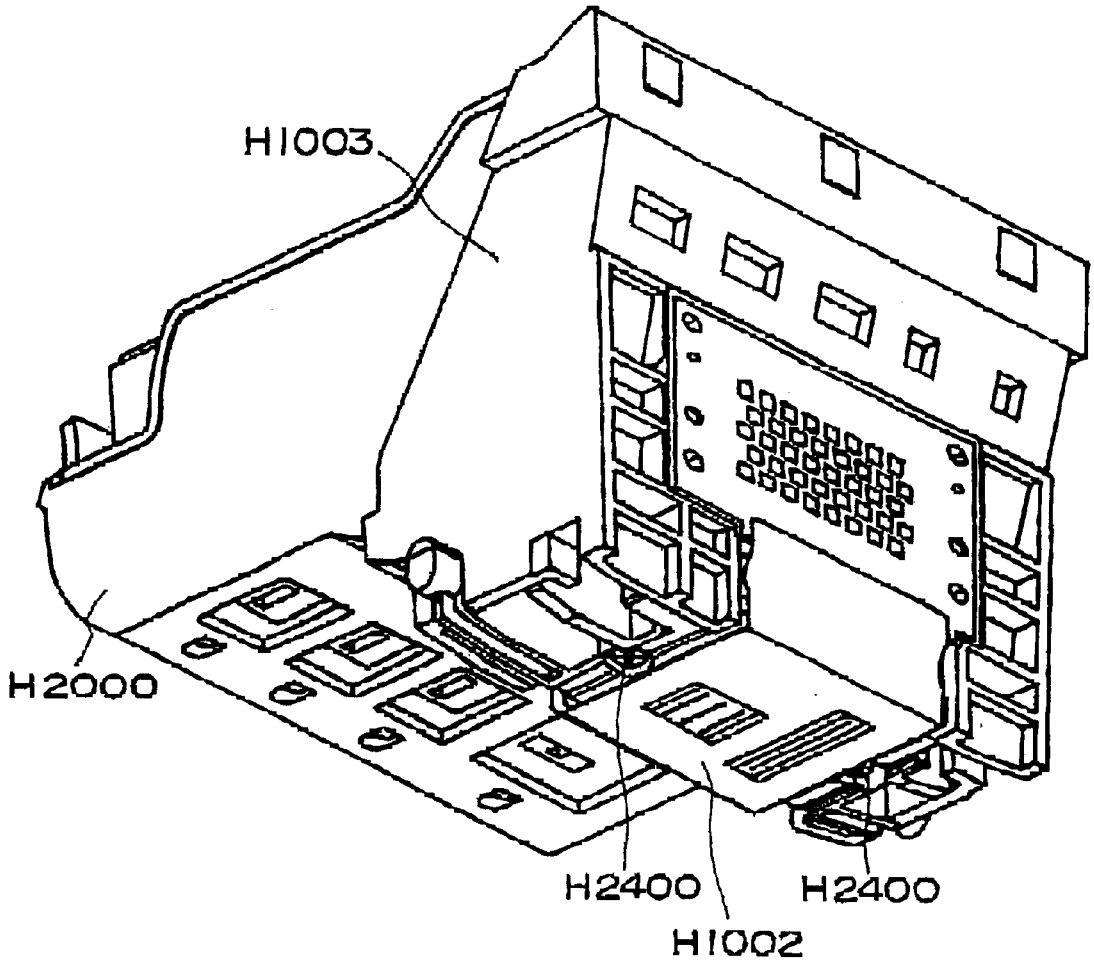
FIG. 1 is a perspective view of the recording head cartridge in the first embodiment of the present invention
Figure 2:
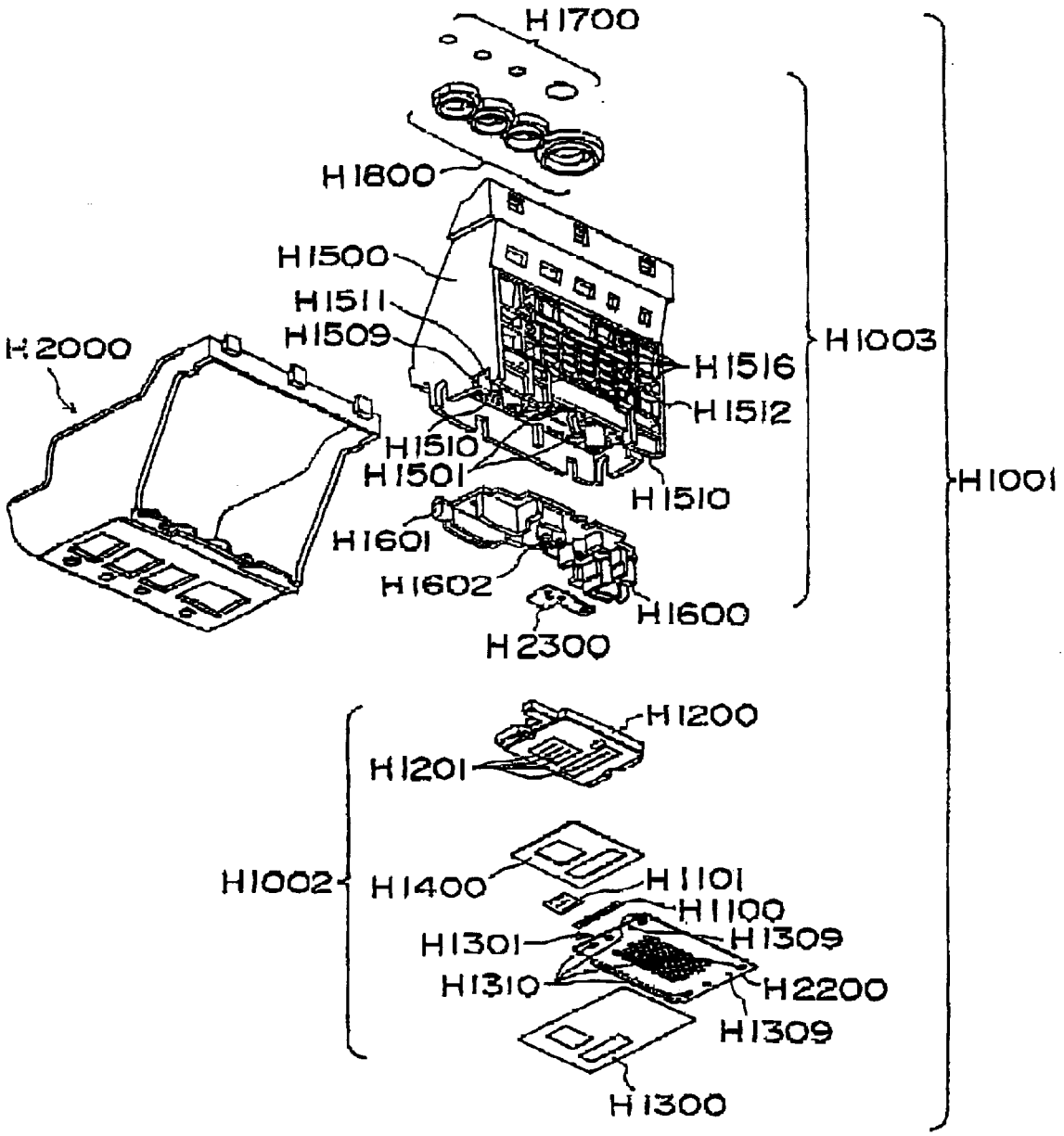
FIG. 2 is a perspective view of the recording head in FIG. 1, for showing the structure thereof.

As is evident from FIGS. 1 and 2, the recording head (ink jet recording head) in this embodiment is one of the structural components of the recording cartridge, which comprises the recording head and a single or plurality of ink containers removably attachable to the recording head. The recording head ejects ink (recording liquid), which is supplied from the ink containers, in accordance with recording data.

This recording head cartridge is removably mountable on a carriage (unshown) of the main assembly of an image forming apparatus. As it is mounted on the carriage, it is rigidly held to the carriage by an aligning means and electrical contacts of the carriage. The recording head cartridge holds four ink containers, which are black, cyan, magenta, and yellow ink containers, each of which is exchangeable, and is removably attacheable to the rubber seal H1800 side of the recording head, reducing the cost for printing with the use of an ink jet recording apparatus.

Next, the structural components of the recording head will be described in detail in regular order.

(1) Recording Head

A recording head H1001 is a side shooter type recording head which employs a bubble-jet recording method, which records an image with the use of a plurality of electrothermal transducers (recording element) for generating thermal energy for heating ink to a point of film-boiling in response to electrical signals.

Referring to FIG. 2, which is an exploded perspective view of the recording head H1001, the recording head H1001 comprises a recording element unit H1002, an ink supplying unit H1003 (recording liquid supplying means), and an ink container holder H2000.

The recording element unit H1002 comprises a first recording element chip H1100, a second recording element chip H1001, a first plate (first supporting member) H1200, an electrical wiring tape H1300 (flexible wiring board), an electrical contact chip H2200, and a second plate H1400 (second supporting member). The ink supplying unit H1003 comprises an ink supplying member H1500, an ink flow path formation member H1600, a joint sealing member H2300, filters H1700, and rubber seals H1800.

(1-1) Recording Element Unit

Figure 3:
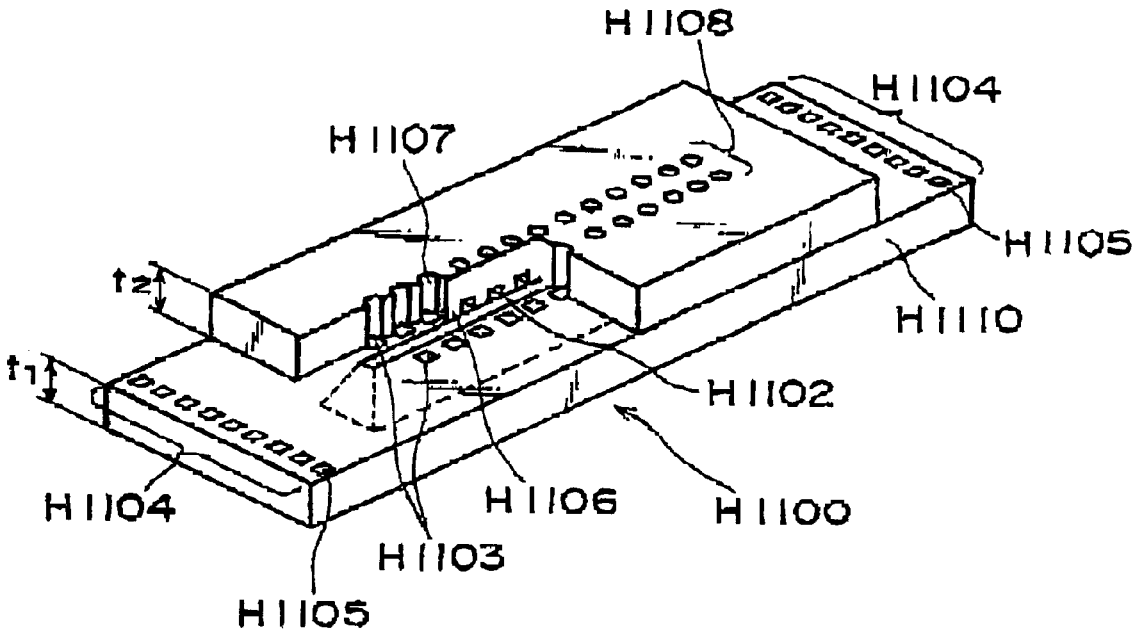
FIG. 3 is a perspective view of one of the recording element chips in the first emdodiment of the present invention, a portion of which has been removed to show the structure thereof.

FIG. 3 is a perspective view of the first recording element chip H1100, a portion or which has been removed to depict the structure thereof.

The first recording element chip H1100 comprises a 0.51 mm thick silicon substrate 1110, a plurality of recording elements (electrothermal transducers) H1103, and a plurality of electrical wires of aluminum, or the like, for supplying electrical power to each electrothermal transducer H1103.

The pluralities of the recording elements and electrical wires are formed on one surface of the substrate H1110 using film formation technologies. The first recording element chip H1100 is also provided with a plurality of ink flow paths and a plurality of ejection orifices H1107, which are formed by photolithography, and the positions of which correspond to those of the plurality of electrothermal transducers H1103, one for one. Further, the first recording element chip H1100 is provided with an ink supplying hole H1102 for supplying the plurality or ink flow paths with ink. One end of the ink supplying hole H1102, in terms of the direction in which ink is ejected, is connected to the plurality of ink flow paths, and the other end of the ink supplying hole H1102 opens at the surface at the substrate 1110, on the side opposite to the surface (back side) where the plurality of the ink flow paths are present. The recording element chip H1100 is fixed to the first plate H1200 with the use of adhesive, and the ink supplying hole H1102 is in the first plate H1200. Further, to the first plate H1200, the second plate H1400 having a couple of holes is fixed with the use of adhesive, and also to the first plate H1200, the electrical wiring tape H1300 is held so that the electrical wiring tape H1300 is electrically connected to the recording element chip H1100 through the second plate H1400. This electrical wiring tape H1300 is for applying electrical signals for ink ejection, to the recording element chip H1100. It has electrical wiring and an external signal input terminal H1301. The electrical wiring in correspondent to the recording element chip H1100, and the external signal input terminal H1301 is a terminal through which electrical signals are received from the printer main assembly. The external signal input terminal H1301 is fixed to the back side of the ink supplying member H1500, being aligned with the ink supplying member H1500.

The ink supplying hole H1102 is formed with the use of such methods as anisotropic etching which takes advantage of the crystal orientation of silicon, or sand blasting. More specifically, when the crystal orientation of the silicon substrate of the recording element chip H1100 is <100> relative to the direction of the plane of the wafer, and <111> relative to the thickness direction of the wafer, the substrate H111 can be etched at an angle of approximatey 54.7 degrees with the use of alkaline based anisotropic etching; the substrate of the recording element chip H1100 is etched to a predetermined depth to form the ink supplying hole H1102, which are through holes with an elongated cross section. The aforementioned plurality of electrothermal transducers H1103 are aligned in two straight columns, which are parallel to each other and sandwich the ink supplying hole H1102.

The two columns of the electrothermal transducers are slightly displaced from each other in their lengthwise direction, making the electrothermal transducers in one column offset from the corresponding electrothermal transducers in the other column, in terms of the direction perpendicular to the lengthwise direction of the two columns. The electrothermal transducers H1103 and the electrical wires of aluminum or the like for supplying the electrothermal transducers H1103 with electrical power, are formed by film formation technologies. Further, the recording element chip H1100 is provided with a plurality of electrodes H1104 for supplying the electrical wires with electrical power, which are located at both ends of the silicon substrate H1110, in terms of the direction in which the electrothermal transducers are aligned, being aligned along the edges of the silicon substrate H1110. Each electrode H1104 is provided a bump H1105 of Au or the like, which is attached thereto by ultrasonic thermal compression bonding. Also located on the silicon substrate H1110 are a plurality of ink flow path walls H1106 for forming the ink flow paths, and a plurality of ejection orifices H1107, which are formed of resinous material, by photolithography, providing an ejection orifice array H1108. The positions of the ink flow paths and ejection orifices correspond to those of the electrothermal transducers H1103. Since the ejection orifices H1107 are positioned in manner to oppose the electrothermal transducers H1103, the ink supplied through the ink supplying hole H1102 is ejected from the ejection orifices H1107 by the bubbles generated by the heat generating function of the electrothermal transducers H1103.

Figure 4:
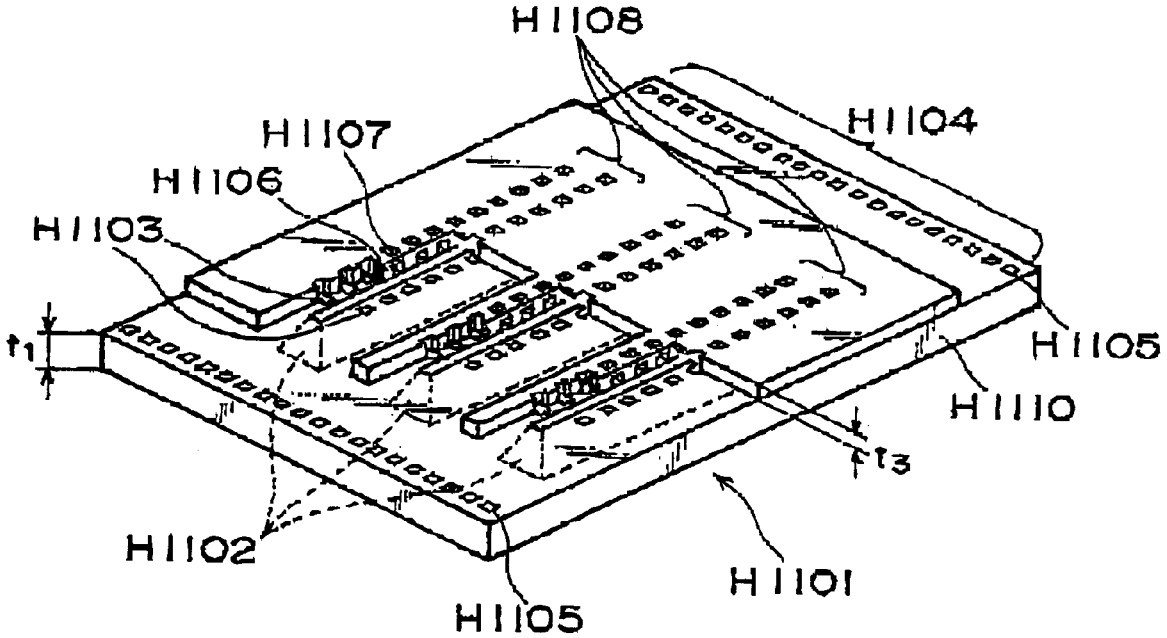
FIG. 4 is a perspective view of another recording element chip in the first embodiment of the present invention, a portion of which has been removed to show the structure thereof.

FIG. 4 is a perspective view of the second recording element chip H1101, a portion of which has been removed to show the structure thereof.

The second recording element chip is a recording element chip for ejecting three color inks different in color. It has three parallel ink supplying holes H1102. On both sides of each ink supplying hole H1102, a plurality of electrothermal transducers H1103 are aligned in a straight column, and so are the a plurality of ink ejection orifices H1107. The second recording element chip H1101 is also provided with the plurality of ink supplying holes, the plurality of electrothermal transducers H1103, a plurality of electrical wires, a plurality of electrodes H1104, which are in or on the silicon substrate H1110. The second recording element H1101 is also provided with a plurality of ink flow paths and a plurality of ink ejection orifices H1107, which are formed of resinous material by photolithography. Further, as is the first recording element chip H1100, the second electrode chip H1101 is provided with a plurality of electrodes H1104 for supplying the electrical wires with electrical power, which are provided a bump H1105 of Au or the like.

The first plate H1200 is 0.510 mm thick, and is formed of alumina (Al2O3) or the like. The selection of the material for the first plate H1200 does not need to be limited to alumina. In other words, any material may be used as the material for the first plate H1200, as long as the material is equal to the recording element chip H1100 in linear expansion coefficient, and is equal or higher than the recording element chip H1100 in thermal conductivity. For example, the material for the first plate H1200 may be any material among silicon (Si), aluminum nitride (AlN), zirconia, silicon nitride (Si3N4), silicon carbide (SiC), molybdenum (Mo), and tungsten (W). The first plate H1200 is provided with ink supplying holes H1201 for supplying the first recording element chip H1100 with black ink, and three ink supplying holes H1201 for supplying the second recording element chip H1101 with cyan, magenta, and yellow inks. The ink supplying holes H1102 in the silicon substrates correspond to the ink supplying holes H1201 of the first plate H1200, one for one, and the first and second recording element chips H1100 and H1101 are fixed to the first plate H1200 with the use of adhesive, being accurately positioned thereto. The adhesive for the first adhesive layer is desired to be low in viscosity and hardening temperature, short in hardening time, relatively high in the hardness after hardening, and resistant to ink. For example, the adhesive for the first adhesive layer may be thermohardening adhesive, the main ingredient of which is epoxy resin.

The thickness of the first adhesive layer is desired to be no more than 50 $\mu$m.

The electrical wiring tape H1300 is a tape for applying electrical signals for ink ejection, to the first and second recording element chips H1100 and H1101. The electrical wiring tape H1300 comprises a plurality of device holes (openings) H1 and H2 through which the recording element chips H1100 and H1101 are put for assembly; electrical terminals H1302 which correspond to the electrodes H1104 of the recording element chips H1100 and H1102; and an electrical terminal portion which is located at one end of the electrical wiring tape H1300 to establish electrical connection between the electrical wiring tape H1300 and the electrical contact board 2200 having the external signal input terminals H1301 for receiving the electrical signals from the printer main assembly. This electrical terminal portion and electrical lead wires H1302 are connected by a continuous wiring pattern formed of copper foil. The electrical wiring tape H1300 is a flexible wiring board which has a laminar structure, having two layers, for example, and the surface of which is coated with a resist film. To the portion of the back side (outwardly facing side) of the electrical wiring tape H1300, which corresponds to the portion of the front side, on which the external signal input terminals 1301 are located, a reinforcement plate is adhered to keep it flat. As the material for the reinforcement plate, 0.5–2.0 mm thick plate of heat resistant substance, for example, glass, epoxy, aluminum, or the like, is used.

The electric wiring tape H1300 is connected to each of the first and second recording element chips H1100 and H1101. As for the connecting method, the bumps H1105 of the electrodes H1104 on the recording element chip substrates are connected to the electrodes H1302 of the electric wire tape H1300 by ultrasonic thermal compression bonding.

The second plate H1400 is, for example, a single piece of 0.5–1.0 mm plate formed of ceramic such as alumina (Al2O3) or metallic material such as aluminum or stainless steel, for example. However, the choice of the material for the second plate H1400 does not need to he limited to those listed above. In other words, any material will suffice as long as it has a linear expansion ratio equal to those of the first and second recording element chips H1100 and H1101, and first plate H1200, and a thermal conductivity equal to, or greater than, those.

Further, the second plate H1400 is provided with two holes. One of the holes matches the first recording element chip H1100 in shape, and is greater in size than the external measurement of the recording element chip H1100, whereas the other matches the second recording element chip H1101 in shape, and is greater in size than the external measurement of the second recording element chip H1101. In order to allow the first and second recording element chips H1100 and H1101 to make electrical connection to the electric wiring tape H1300, in the same flat plane, the second plate H1400 is adhered to the first plate H1200 with the use of second adhesive layer H1203, and also is adhered to the back side of the electric wiring tape H1300 with the use of the third adhesive layer H1306.

The electrical junction between the first recording element chip H1100 and electric wiring tape H1300, and the electrical junction between the second recording element chip H1101 and electric wiring tape H1300, are sealed with the first sealant, (unshown) and the second sealant, to protect the electrical junctions from the corrosion by ink, and also from external impacts. The first sealant mainly seals the joints between the electrodes H1302 of the electric wiring tape H1300 and the bumps H1105 of the recording element chips, an the back side, and the peripheries of the recording element chips, whereas the second sealant seals the same joints, on the front side.

The end of the electric wiring tape H1300 is electrically connected to the electrical contact chip H2200 having the external signal input terminals H1301 for receiving the electrical signals from the printer main assembly.

The connection is made with the use of electrically conductive anisotropic film or the like, and thermal compression bonding.

The electric wiring tape H1300 is adhered to the second plate H1400, is bent along edges of the second plate H1400, is extended along the side surfaces of the second plate H1400 and first plate H1200, an the same side, perpendicular to the second and first plate H1400 and H1200, and is adhered to the side surface of the first plate H1200 with the use of third adhesive layer H1306. The adhesive to be used for forming the second adhesive layer H1203 is desired to be low in viscosity so that the second adhesive layer H1203 can be rendered relatively thin. It is also desired to be resistant to ink. The third adhesive layer H1306 is no more than 100 $\mu$m in thickness, and is a thermohardening adhesive layer, the main ingredient of which is epoxy resin, for example.

(1-2) Ink Supplying Unit (recording liquid supplying means)

The ink supplying member H1500 is molded of resinous material, for example. The resinous material is desired to contain glass fibers by 40% in order to improve the ink supplying member H1500 in rigidity for stabilizing its shape.

Referring to FIGS. 1 and 2, the ink supplying member H1500 for removably holding the ink containers is an integral structural part of the ink supplying unit H1003 for loading ink from the ink containers to the recording element unit H1002. It is joined with a liquid flow path formation member H1600 by ultrasonic welding, forming the ink flow paths H1501 extending from the ink containers to the first plate H1200. The joint between the ink supplying member H1500 and each ink container is fitted with the filter H1700 for preventing the invasion of external foreign substances, and the rubber seal H1800 for preventing ink from evaporating from the joint. The filter H1700 and rubber seal H1800 are attached to the joint by welding.

Further, the ink supplying member H1500 comprises: a mounting guide H1601 for guiding the recording head cartridge to the cartridge mounting spot of the carriage in the ink jet recording apparatus main assembly—a cartridge anchoring portion for firmly setting the recording head cartridge on the carriage with the use of a head setting lever; and cartridge stoppers H1509, H1510, and H1511 for aligning the cartridge relative to the referential point of the carriage, in terms of the X, Y, and Z directions. The ink supplying member H1500 also comprises a terminal holding portion H1512 for aligning the electrical contact chip H2200 of the recording element unit H1002 and securely holding it, and a plurality of ribs which are attached to the terminal holding portion H1512 and its adjacencies to improve the terminal holding portion H1512 in rigidity.

(1-3) Joining of Recording Head Unit and Ink Supplying Unit

As shown in FIG. 2, the recording head is completed as the recording element unit H1002 is connected to the ink supplying unit H1003, and the combination of the recording element unit H1002 and ink supplying unit H1003 is joined with th ink container holder H2000. They are joined in the following manner.

In order to connect the ink supplying holes (ink supplying holes H1201 of the first plate H1200) of the recording element unit H1002 and the ink supplying holes (ink supplying holes H1602 of the flow path formation member H1600) of the ink supplying unit H1003 without allowing ink to leak, the two units H1002 and H1003 are fixed to each other, with the interposition of the joint sealing member H2300, with the use of small screws H2400, so that the two units H1002 and H100 are pressed toward each other in a manner to compress the joint sealing member H2300. As the two units H1002 and H1003 are fixed to each other, the recording element unit H1002 is aligned relative to the referential point of ink supplying unit H1003 in terms of the X, Y, and Z directions.

The electrical contact chip H2200 of the recording element unit H1002 is fixed to one of the lateral surfaces of the ink supplying member H1500, being accurately positioned thereto by terminal aligning pins (two) and terminal aligning holes (two). As for the fixing method, the pins with which the ink supplying member H1500 is provided are crimped. However, a different fixing means may be used.

The assembly of the recording head H1001 is completed as the connecting holes and connecting portions of the ink supplying member H1500 are engaged with the counterparts of the container holder H2000.

More specifically, the ink container holder H2000 comprising the ink supplying member H1500, flow path formation member H1600, filters H1700, and rubber seals H1800, is joined with the recording element portion comprising the recording element chips H1100 and H101, first plate H1200, electric wiring tape H1300, and second plate H1400, with the use of adhesive or the like, to complete the recording head. The completed recording head is shown in FIG. 8.

(2) Recording Head Cartridge

As described above, in each ink container, ink different in color from the inks in the other ink containers is stored. Further, each ink container is provided with an ink delivery spout for delivering the ink stored therein to a recording head. As an ink container is mounted into a recording head, the opening of the ink delivery spout is pressed upon the filter H1700 disposed in the joint portion of the recording head, allowing the ink within the ink container to be supplied to the first recording element chip H1100, through the ink delivery spout, ink flow path H1501 of the recording head, and the first plate H1200.

Then, the ink is supplied to the bubble generation chamber having the electrothermal transducer H1103 and ejection orifice H1107, and is ejected therefrom toward recording medium by the thermal energy given to the ink by the electrothermal transducer H1103.

Embodiment 1

Next, referring to FIGS. 5–12, the first embodiment of the present invention will be described.

Figure 5:
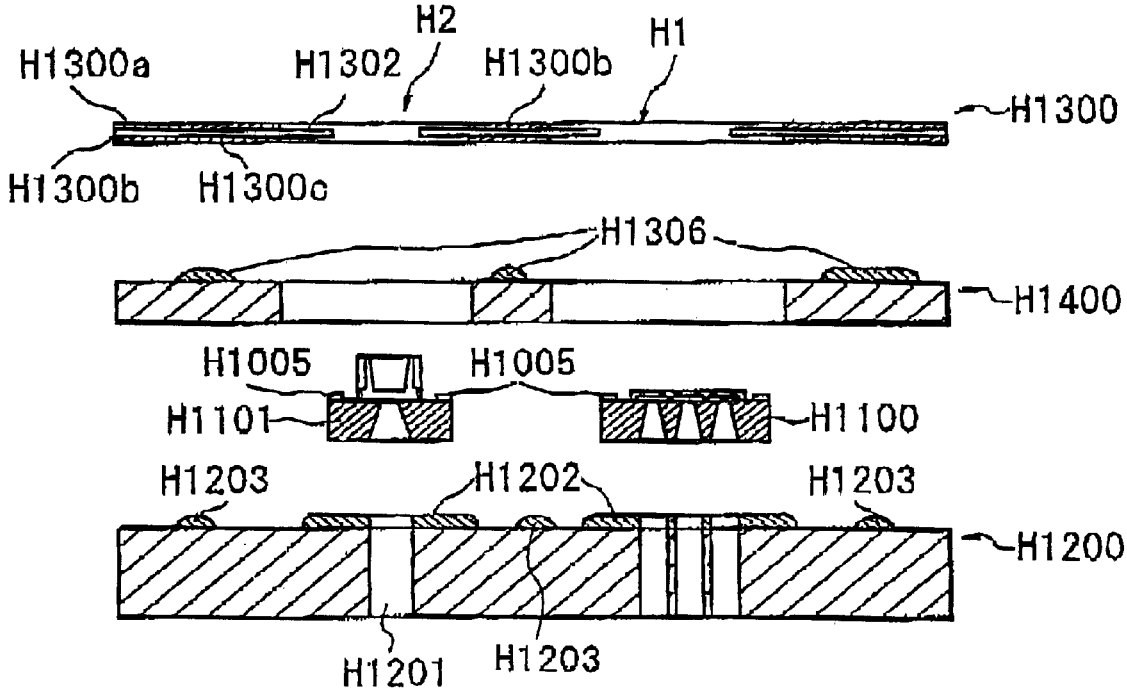
FIG. 5 is a rough, sectional, and exploded drawing of the essential portion of the recording element unit in the first embodiment of the present invention.
Figure 6:
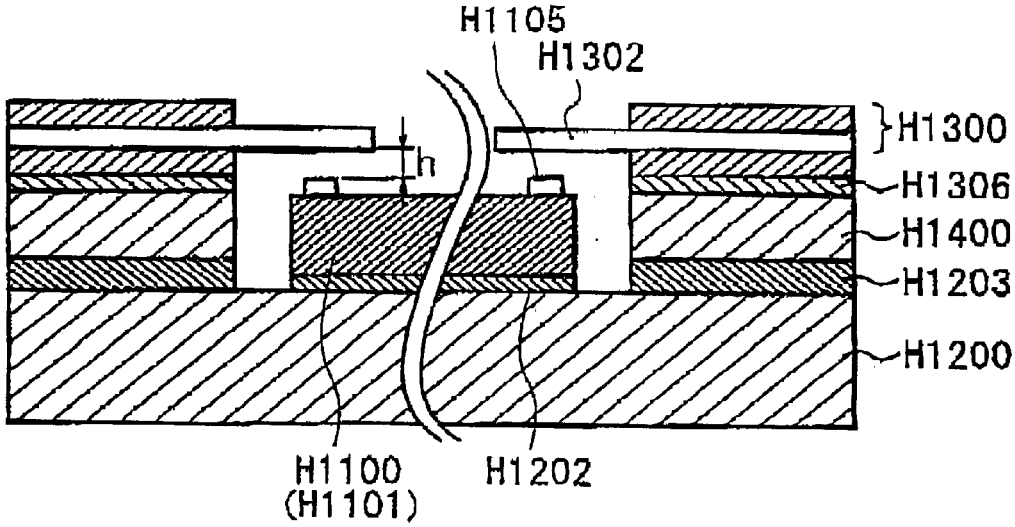
FIG. 6 is a enlarged sectional view of the essential portion of the recording element unit in the first embodiment of the present invention.

FIG. 5 is a rough, exploded, and sectional view of the essential portion of the recording element unit H1002, and FIG. 6 is a rough sectional view of the essential portion of the recording element unit H1002.

As is evident from FIG. 5, the fringe portions, or bonding portions, of the electric wiring tape H1300 has three layers, which are a base film H1300*a* of polyimede, or the surface layer; a copper foil H1300*b*, or the middle layer; and a solder resist H1300*c*, or the bottom layer. This electric wiring tape H1300 is provided with the device holes (opening) H1 and H2 in which the first and second recording element chips H1100 and H1101 are fitted, respectively. It is also provided with inner leads H1302 (electrode leads) to be connected the bumps H1005 of the recording element chips H1100 and H1101. The inner leads H1302 are plated with gold and are exposed from the electric wiring tape H1300.

Next, referring to FIGS. 9 and 10, the processes in a manufacturing method for the recording element unit in this embodiment will be described in the order in which the processes are carried out.

First, a manufacturing method for the first recording element chip H1100 and a manufacturing method for the second recording element chip H1101, will be described.

FIGS. 10–16 are rough sectional views of the essential portion of the first or second recording element chip (ink jet recording head), which consecutively show the structure of the essential portion after the completion of each manufacturing process, in the order in which the processes are carried out.

First, referring to FIG. 10, in this embodiment, a substrate 1 formed of glass, ceramics, plastics, metal, or the like, is prepared.

The substrate 1 is not limited in shape and material as long as the selected shape and material allow the substrate 1 to become a part on the liquid flow path formation member, and also a part of the supporting member for supporting a layer of material in which the ink flow paths and ink ejection orifices, which will be described later, are formed. On the substrate 1, a predetermined number of ink ejection energy generation elements 2 such as electrothermal transducers, piezoelectric elements, or the like, are placed in an orderly manner. The ejection energy for ejecting recording liquid droplets is given to the ink by these ink ejection energy generation elements, to record an image. For example, if the electrothermal transducers are employed as the ink ejection energy generation elements, they heat the recording liquid in their adjacencies to cause the recording liquid to change in state to generate the ejection energy. If the piezoelectric elements are employs, the ejection energy is generated by the mechanical vibrations of the piezoelectric elements.

Each element 2 is connected to a control signal input electrode 8 for activating the element 2. Generally, for the purpose of improving the durability of the element 2, various functional layers, for example, a protective layer, are provided. Needless to say, the provision of such layers does not have adverse effects upon the application of the present invention.

FIG. 10 shows a recording element chip manufacturing method in which the substrate 1 is provided in advance with an ink supplying hole 3, and ink is supplied from the back side of the substrate 1. However, the hole 3 may be formed at any point of the manufacture, and using any method as long as the hole 3 can be formed in the substrate 1. For example, the hole 3 may be formed by mechanical means, for example, a drill or the like, or may be formed with the use of optical means, for example, a laser or the like.

Further, the hole 3 may be chemically etched after coating the substrate 1 with a pattern formed of resist or the like.

Obviously, the ink supplying hole may be formed in the patterned resin layer; it may be formed in the same resin layer at the ejection orifices.

Next, referring to FIG. 11, ink flow path pattern 4 is formed of dissolvable resin, on the substrate on which the aforementioned plurality of the ink ejection energy generation elements 2 have been formed. As the most commonly used means for forming the ink flow path pattern 4, a means which uses photosensitive substance can be listed, but the ink flow path pattern 4 can be formed by a different means, for example, the screen printing method or the like. When photosensitive substance is used, the ink flow path patterns are dissolvable. Therefore, positive resist, or negative resist changeable in dissolvability, may be used.

Regarding the method for forming a resist layer, when a substrate in which an ink supplying hole has been formed in advance is used, the photosensitive substance is dissolved in appropriate solvent, and the solution is coated on PET film or the like to create dry film of photosensitive substance. Then, the dry film is laminated onto the substrate, preferable material for the photosensitive dry film is optically disintegratable high polymer compound containing vinyl ketone, for example, polymethyl-isopropyl-ketone and polyvinyl-ketone, because, before the exposure to light, the dry film formed of any of these compound has the same properties (ability to be stretched into film) as the high polymer compound, being therefore easily laminatable even across the ink supplying hole 3.

Also, the resist layer may be formed by spin coating method, roller coating method, or the like, with the ink supplying hole 3 filled with filler removable in a process thereafter.

Next, referring to FIG. 12, on the dissolvable resin layer 4 patterned in the form of an ink flow path, overcoat resin layer 5 is formed by an ordinary spin or roller coating method, or the like. More specifically, the material for the overcoat resin layer 5 is dissolved in solvent, and the thus obtained solution is coated by spin coating, roller coating, or the like, on the pattered resin layer 4 which is dissolvable. Therefore, in order to prevent the patterned dissolvable resin layer 4 from being deformed, such solvent that does not dissolve the patterned resin layer 4 must be chosen as the solvent in which the material for the overcoat resin layer 6 is to be dissolved.

Next, the overcoat resin layer 5 in this embodiment will be described.

In order for the ink ejection orifice 3 to be easily and precisely formed by photolithography, the material for the overcoat resin layer 5 is desired to be photosensitive. Further, the material for the overcoat resin layer 5 is required to possess mechanical strength high enough to be structural material, to be compatible with the substrate 1 in terms of mutual adhesion, to be resistant to ink, and to be high enough in resolving power to accurately reflect the microscopic pattern of each of the plurality of microscopic ejection orifices. Therefore, cationic epoxy compound is preferable as the material for the overcoat resin layer 5, since it has mechanical strength high enough to be structural material, is compatible with the substrate 1 in terms of mutual adhesion and resistant to ink, remains solid at the normal temperature, and it excellent in the properties related to patterning.

Hardened cationic epoxy compound is higher in degree of crosslinking (high in Tg) than hardened ordinary acid anhydride or amine, displaying properties suitable for structural material. Further, usage of epoxy resin which is in solid state at the normal temperature prevents the polymerization initiation seeds, which are generated by cationic polymerization initiator and exposure to light, from diffusing into the epoxy resin. Therefore, a high degree of pattern accuracy can be realized.

When forming the overcoat resin layer in a manner to cover the dissolvable resin layer, it is to be desired that the solution obtained by dissolving the material for the overcoat resin layer, which is in the solid state at the normal temperature, in solvent, should be coated on the dissolvable resin layer by spin coating.

With the use of spin coating, that is, a thin film coating technology, the overcoat resin layer 5 can be precisely formed in uniform thickness, and the distance between the ink ejection pressure generation element 2 and orifice can be reduced, which is difficult to do with the use of the conventional method, making it possible to eject lipid in the form of a much smaller droplet.

In order to form a flat overcoat resin layer 5 on the dissolvable resin layer 4, the weight ratio of the material for the overcoat resin layer 5 relative to the solvent, in the solution to be spin coated, is desired to be within a range of 30–70 wt %, preferably, a range of 40–60 wt %.

As for the types of the solid epoxy resins usable in this embodiment, the following can be listed: resultant from the reaction between biphenol A and epichlorohydrin, which is 900 or more in molecular weight, resultant from the reaction between bromophenol A and epichlorohydrin, resultant from the reaction between phenoinovolak or o-cresolnovolak, and epichlorohydrin, and the like. Further, there is the multifunctinal epoxy resin having oxycyclohexane skelton, which has been disclosed in Japanese Laid-open patent Applications Sho 60-161973, Sho 63-221121, Sho 64-9216, and Hei 2-140219.

As for the photo/cationic polymerization initiators for hardening the above listed epoxy resins, the following may be listed: aromatic iodic salt, aromatic sulfonium salt (J. POLYMER SCI: Symposium No. 56 383–395 (1976)], SP-150 and SP-170 marketed by Ashahi Denka Kogyo, Co, Ltd., Japan and the like.

Next, referring to FIG. 13, the photosensitive overcoat resin layer 5 formed of the above described compound is exposed through a mask 6.

The material for the photosensitive overcoat resin layer 5 in this embodiment is of negative type, and therefore, the portions of the photosensitive overcoat resin layer 5, which will become an ink ejection orifice, are shielded by the mask 6 (obviously, the portions which will become the holes through which electrical connection is established are also shielded, but are not shown in the drawing).

As for the medium to be used for exposure, an appropriate one can be chosen from among ultraviolet ray, deep ultraviolet ray, electron beam, X-ray, and the like, in accordance with the sensitivity range of the photo/cationic polymerization initiator employed for the process.

In this embodiment, the resinous substance used as the material for forming nozzles, or holes, for ejecting black ink is virtually the same as that for color inks in this embodiment. However, the material for the resin layer in which the black ink ejecting holes are formed and the material for the resin layer in which the color ink ejecting holes are formed, are differentiated in properties by differentiating them in the solvent and the viscosity of the solution into which they are made, to make the recording element chip for black ink different from the recording element chip for color inks, in the distance OH between the outward end of an ejection orifice and a recording element.

More specifically, when formulating the resinous material for forming color ink nozzles, approximately 60 parts in weight of epoxy resin is mixed with approximately 40 parts in weight of solvent such as MIBK, diglyme, or the like, to obtain a solution having a viscosity of approximately 60 (mPa.s).

This solution is spin coated once to realize an OH of approximately 25 $\mu$m.

When formulating the resinous material for forming black ink nozzles, approximately 60 parts in weight of epoxy resin is mixed with approximately 40 parts in weight of solvent such as xylene or the like, to obtain a solution having a viscosity of approximately 120 (mPa.s). This solution is spin coated three times to realize an OH of approximately 75 $\mu$m. After the spin coating and drying, the dry film for forming the black ink nozzles and the dry film for forming the color ink nozzles, are both subjected to the patterning process, using the same apparatus, to make the heads.

As is evident from the above description, the recording element chip for black ink and recording element chip for color inks are the same in wafer (identical in wafer thickness), but are different in the resin layer (different in thickness) in which nozzles are formed. However, the nozzle layers for both chips can be formed by the same spin coating, and can be exposed for patterning, with the use of the same exposing device, eliminating therefore the need for a dedicated process for each chip. In other words, the two chips different in the OH can be manufactured through the same processes.

In the processes up to this point, all alignments can be done with the use of conventional photolithography technologies making the ink jet head manufacturing method in accordance with the present invention far superior in accuracy then a method in which an orifice plate is produced independently from the substrate, and then is pasted to the substrate. If necessary, the photosensitive overcoat resin layer 5, which has been exposed in a predetermined pattern, may be subjected to a heat treatment to enhance the reaction. Since the photosensitive overcoat resin layer 5 is formed of epoxy resin which is solid at the normal temperature, as described before, the cationic polymerization initiator seeds generated by the pattern exposure are prevented from diffusing, making it possible to realize a high degree of patterning accuracy.

Figure 14:
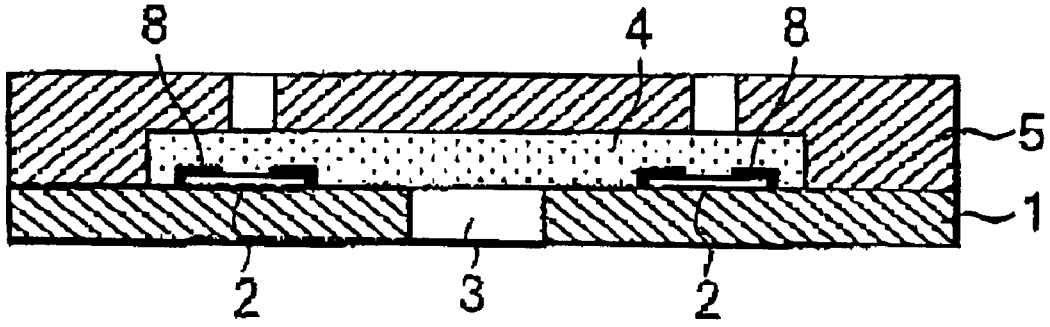
FIG. 14 is a sectional view of the recording element chip after the development of the overcoat resin layer exposed to the ejection orifice pattern.
Figure 15:
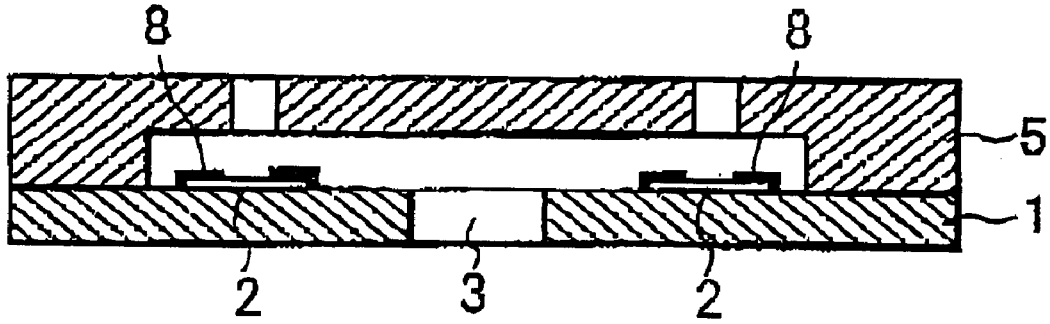
FIG. 15 is a sectional view of the recording element chip after the patterned dissolvable resin has been dissolved away.

Next, after being exposed in the pattern, the photosensitive overcoat resin layer 5 is developed with the use of appropriate solvent. As a result, ink ejection orifices are forced as shown in FIG. 14. It should be noted here that the dissolvable patterned resin layer 4, which will become the ink flow path, may be dissolved at the same time as the unexposed portions of the photosensitive overcoat resin layer 5 are dissolved. However, generally, a plurality of identical or different heads are formed on the same substrate 1, and are separated into individual ink jet recording heads through a dicing process which creates dicing dust. Thus, as a countermeasure for the dicing dust, only the photosensitive overcoat resin layer 5 may be developed, leaving undeveloped the resin layer 4 patterned in the form of an ink flow path as shown in FIG. 14 (presence of the patterned resin layer 4 prevents the entrance of the dicing dust). In this case, the patterned resin layer 4 is developed after the dicing process (FIG. 15). Also in this case, the scum (remnant from development) generated when developing the photosensitive overcoat resin layer 5 is dissolved away with the dissolvable resin layer 4, and therefore, no scum will remain in the nozzles.

When it is necessary to increase the crosslinkage density as described above, the photosensitive overcoat resin layer 5, in which the ink flow paths and ink ejection orifices have been formed, may be dipped in a solution containing reducing agent, and heated, to increase the hardness of the overcoat resin layer 5. Not only these processes further improve the photosensitive overcoat resin layer 5 in crosslinkage density, but also in the properties related to its adhesion to the substrate 1 and ink resistance.

Needless to say, this process in which the photosensitive overcoat resin layer 5 is dipped in this hardening solution containing copper ions and heated therein, may be carried out immediately after the ink ejection orifices are formed by developing the photosensitive overcoat resin layer 5 exposed in the predetermined pattern. In such a case, the patterned dissolvable resin layer 4 is dissolved thereafter. As for the dipping/heating process, the photosensitive overcoat resin layer 5 may be heated while it is in the hardening solution, or after the dipping.

As for the reducing agent, any substance will suffice as long as it is capable of reducing. However, chemical compounds such as copper triflate, copper acetate or copper benzoate, which contains copper ions, are particularly effective. Among these compounds, copper triflate is exceedingly effective. In addition to those listed above, ascorbic acid is also effective.

Figure 16:
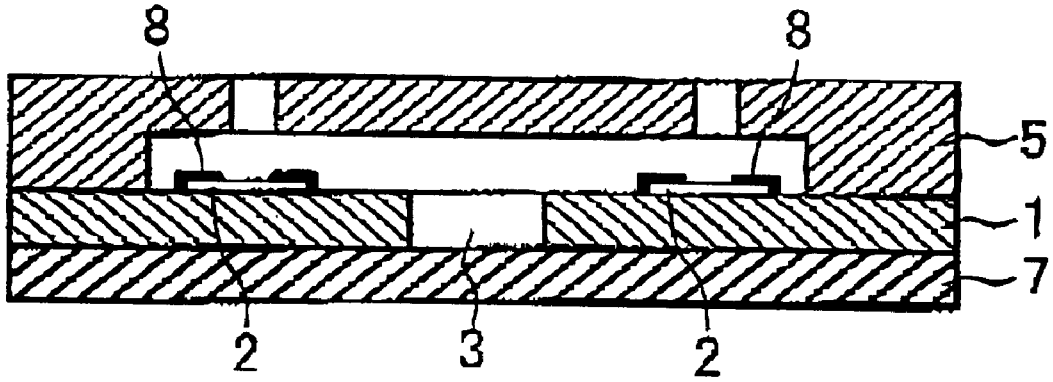
FIG. 16 is a sectional view of the recording element chip after the attachment of the ink supplying member.

To the substrate in and on which ink flow paths and ink ejection orifices have been formed, a member 7 for supplying ink, and electrical wiring and terminals (unshown) for driving the ink ejection pressure generation elements, are attached, to complete an ink jet recording head (FIG. 16).

In this embodiment, the ink ejection orifices are formed by photolithography. The compatibility of the present invention is not limited to photolithography. For example, the ink ejection orifices may be formed by a dry etching which employs oxygen plasma, or by an excimer laser. In such a case, a different mask is used. When forming the ink ejection orifices with the use of an excimer laser or dry etching, the substrate is not damaged by the laser beam or plasma beam, because it is protected by the resin pattern.

Therefore, it is possible to provide a recording head which is more precise and reliable. Also when dry etching, an excimer laser, or the like, is used to form the ink ejection orifices, thermally hardening substance can be used as the material for the overcoat resin layer 5, in addition to the photosensitive substance.

The recording element chips H1100 (black) and H1101 (color) are approximately the same in silicon wafer thickness (approximately 625 $\mu$m).

After the recording elements and wiring are formed on the wafer, and the ink ejection nozzles are formed in the resinous layer coated on the wafer, the bumps are formed on the electric contact pad of each recording element chip. Thereafter, the wafer is diced into a plurality of separate recording element chips.

In this embodiment, the second plate H1400, which is pasted in advance to the first plate H1200 with the use of adhesive, is provided with a hole in which the first recording element chip is fitted, and a hole in which the second recording element chip is fitted.

Next, the first plate H1200 is mounted in a pasting apparatus, being accurately aligned therewith. Then, epoxy adhesive, which is curable with ultraviolet ray/heat, is coated on the first plate H1200, across the areas to which the first recording element chip H1100 is pasted. Next, the first recording element chip H1100 is precisely aligned with the first plate H1200 by processing the image of an alignment mark provided on the first recording element chip H1100 with the use of a camera provided on the pasting apparatus, and is pasted to the first plate H1200. During this process, the aforementioned adhesive is applied by an amount large enough for the adhesive to slightly ooze out from the edges of the recording element chip H1100. Then, ultraviolet ray is projected to the first recording element chip H1100 and its adjacencies while holding down the first recording element chip H1100 by the pasting apparatus, to harden the adhesive enough to prevent the pasted first recording element chip H1100 from shifting. Next, the second recording element chip H11001 is pasted to the first plate H1200 in the same manner as the first recording element chip H1100, the adhesive being also hardened enough to prevent the second recording element chip H1101 from shifting. During this process, a part of the alignment camera can be used for aligning both the first and second recording element chips H1100 and H1101, because both are essentially identical in thickness (excluding the nozzle containing layer). Thereafter, the adhesive is thermally hardened in an oven.

Next, the electric wiring tape H1300 is aligned with the electrical contact portions of the first and second recording element chips H1100 and H1101 (by image processing, in this embodiment) which have been pasted to the first plate H1200. Then, the electric wiring tape H1300 is pasted to the second plate H1400, which has been pasted to the first plate H1200 with the use of adhesive, and the bumps of the first and second recording element chips H1100 and H1101 are electrically connected to the electrode leads of the electric wiring tape H1300 by ultrasonic thermal compression bonding. In this embodiment, the second plate H1400 is given such a thickness that, as the electric wiring tape H1300 is pasted to the second plate 1400, the positions of the bumps of the first and second recording element chips H1100 and H1101, in terms of the thickness direction of the chips, match those of the electrode leads of the electric wiring tape H1300.

Next, the joints between the bumps H1105 on the electrodes H1104 of the first and second recording element chips H1100 and H1101 and the electrode leads H1303 of the electric wiring tape H1300 are sealed with resin to prevent ink or the like from causing short circuits.

Figure 7:
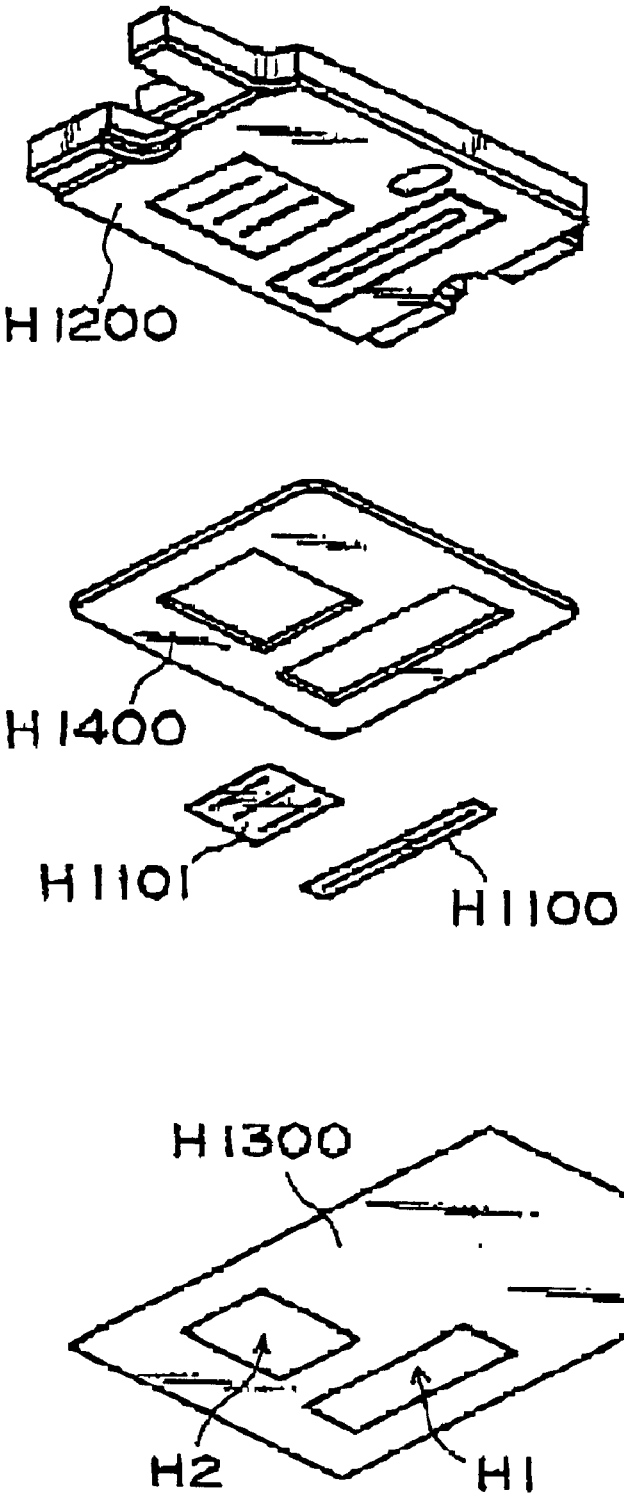
FIG. 7 is an enlarge, exploded, and perspective view of the essential portion of the recording element unit in the first embodiment of the present invention.
Figure 8A:
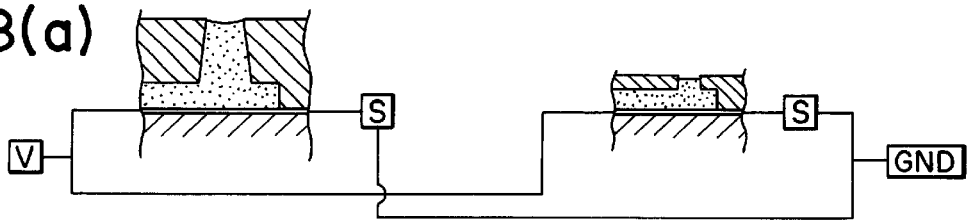
FIGS. 8A, 8B, 8C and 8D, is a rough drawing for depicting the two types of an ink ejecting method.
Figure 8B:
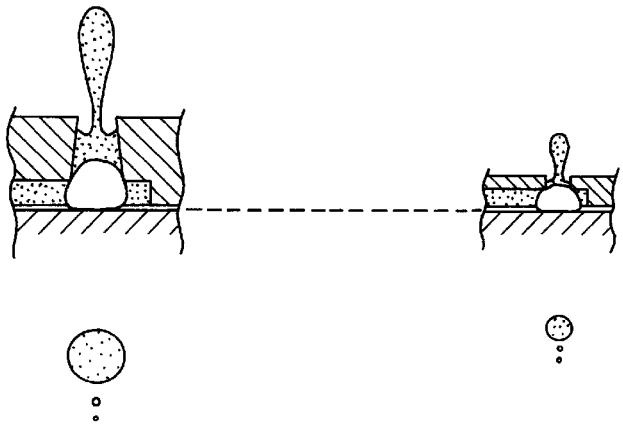
Figure 8C:
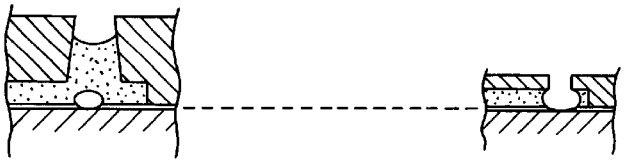
Figure 8D:
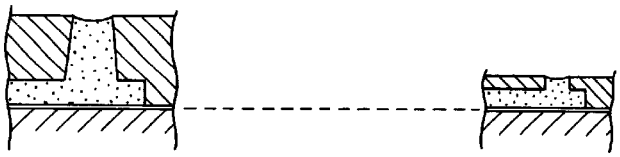

FIG. 7 is an enlarged, exploded, and perspective view Of the first and second plates H1200 and H1400, the first and second recording element chips H1100 and H1101, and electric wiring tape H1300, which are shown in FIG. 2. Next, referring to FIGS. 5–7, the structure of the recording head in this embodiment will be described in more detail.

In this embodiment, the first and second plates H1200 and H1400 are formed of aluminum. The electric wiring tape H1300 (flexible printed circuit) is structured in three layers, which are the base film layer, copper foil wiring layer, and solder resist layer. Further, the electric wiring tape H1300 is provided with electrodes leads H1302, which are gold plated, and are exposed from the electric wiring tape H1300. The second plate H1400 in this embodiment is a single piece of plate, and is provided with a hole in which the first recording element chip H1100 is fitted, and a hole in which the second recording element chip H1101 is fitted.

It is fixed to the first plate H1200 with the use of adhesive. The electric wiring tape H1300 is provided with device holes H1 and H2 in which the first and second recording element chips H1100 and H1101 are fitted, respectively, and is adhered to the second plate H1400 by the third adhesive layer H1306, by the entire surface.

In the ink jet recording apparatus in this embodiment, the black and color recording element chips are combined by being adhered to the same supporting substrate, and therefore, it is unnecessary for the two chips to be adjusted in terms of ink droplet landing spot.

In this embodiment, black ink is ejected using the first recording element chip H1100 of the ink jet recording head structured as described above, and three color inks, which are cyan, magenta, and yellow inks, are ejected using the second recording element chip H1101 of the same recording head.

As for the nozzle arrangement in the first recording element chip H1100, the ink ejection nozzles are aligned in two straight columns, which sandwich the ink supplying hole. The two columns are slightly displaced from each other in terms of the direction parallel to the columns, so that the nozzles are arranged in a zig-zag line in terms of the direction perpendicular to the columns. In each column of the nozzles, the nozzles are aligned at a density equivalent to a resolution of 300 dpi, enabling therefore the first recording element chip record at a resolution of 600 dpi. The second recording element chip H1100 is provided with three ink supplying holes, which are for supplying cyan, magenta, and yellow inks, one for one, and each ink supplying holes is sandwiched by two straight columns of ink ejection nozzles, which are also slightly displaced relative to each other in the direction parallel to the columns, so that nozzles are arranged in a zig-zag line in terms of the direction perpendicular to the columns. In the case of the second recording element chip H1101, however, in each column of the nozzles, the nozzles are aligned at a density equivalent to a resolution of 600 dpi, enabling the second recording element chip to record at a resolution of 1200 dpi. Further, in the ink jet recording head in this embodiment, in order to position the two recording element chips H1100 and H1101, that is, the black recording chip and color recording chip, as precisely as possible relative to each other, both recording element chips H1100 and H1101 are mounted on the same plate, or the first plate H1200.

Further, the electrical contact chip H2200 and electric wiring tape H1300 for supplying the recording element chips H1101 and H1101 with electrical power, data, and the like, from the recording apparatus main apparatus, are stared by the two recording element chips H1100 and H1101 to reduce component count and cost.

In this embodiment, as the ink jet recording head is mounted into the carriage of the recording apparatus main assembly, electrical connection is established between the electrical contacts provided on the carriage side and the electrical contact chip H2200 of the ink jet recording head. The recording element chip H1100 for black ink and the recording element chip H1101 for color inks are differently structured so that two recording element chips become different in the amount by which ink is ejected per ejection.

FIG. 8 is a rough sectional view of one of the ejection orifices of the first recording element chip and one of the ejection orifices of the second recording element chips, and their adjacencies, for depicting the manner in which a black ink droplet and a color ink droplet are ejected. In the drawing, the first and second recording element chips are connected to the same electrical power source, and are on the same plane (dotted line).

In this embodiment, in order to stabilize the amount by which ink is ejected per ejection so that a high quality color image can be printed, the second recording element chip H1101 employs the so-called bubble-through-jet type recording method (BTJ recording method).

Referring to FIG. 8, in an ordinary bubble-jet recording method (BJ recording method), the distance OH between an ejection orifice and a recording element (shortest distance between the outward end of an ejection orifice and a recording element) is relatively long, and therefore, when a bubble A is grown in ink I by the heat generated by a recording element (electrothermal transducer), the bubble A remains trapped in the ink In comparison, in the case of the BTJ recording method, the distance OH between an ejection orifice and a recording element is relatively short, and therefore, the bubble A bursts into the atmosphere through the ejection orifice H1107 at the same time as ink is ejected by the bubble A grown by the heat generated by the heat from the recording element H1103.

In the case of a nozzle based on the BTJ method, the product of the cross sectional area SO of an ejection orifice and the distance OH between the ejection orifice and a recording element is virtually equal to an amount Vd by which ink is ejected per ejection (SO×OH is nearly equal to Vd). For example, in order to eject ink by an amount Vd of approximately 5 pl, the distance OH between an ejection orifice and a recording element, and the ejection orifice cross section SO, should be set to 25 $\mu$m and 200 $\mu$m2 (diameter is nearly equal to 16 $\mu$m), respectively.

On the other hand, in the case of the first recording element chip H1100, the ink ejection amount Vd is set to approximately 30 pl to make the black print look beautiful and to increase printing speed. In order to realize this ink ejection amount using the BTJ method when the distance OH between an ejection orifice and a recording element is 25 $\mu$m, the ejection orifice cross section SO needs to be 1200 $\mu$m2 (diameter $\phi$ nearly equal to 39 $\mu$m). In the case of such a nozzle structure, in order to realize the intended ejection amount, a recording element H1103 (electrothermal transducer) of a large size, for example, 35 $\mu$m×35 $\mu$m, must be employed. Further, since the ejection orifice H1107 is larger than the recording element H1103, a liquid droplet ejected from the ejection orifice fail to fly straight. The ejection orifice cross section SO may be reduced by increasing the distance OH between an ejection orifice and a recording element. However, such an arrangement increase flow resistance, making it necessary to further increase the size of the recording element H1103. This is not desirable from the standpoint of energy conservation. Thus, in this embodiment, instead of the BTJ method, an ordinary BJ method is employed for the first recording element chip H1100, or the recording element chip for black ink, and the distance OH between an ejection orifice and a recording element, and ejection orifice cross section SO, are set to approximately 70–80 $\mu$m and 600–800 $\mu$m2, respectively.

Further, in this embodiment, in each ejection orifice column for black ink, the ejection orifices are aligned at a density equivalent to a resolution of 300 dpi (600 dpi in terms of the direction perpendicular to the column), whereas in each ejection orifice column for color ink, the ejection orifices are aligned at a density equivalent to a resolution of 600 dpi (1200 dpi in terms of the direction perpendicular to the column), being different from that for black ink. This arrangement is made to enable both recording element chips H1100 and H1101 to print as fast as possible, that is, by single pass, in spit of the fact that the amount (approximately 30 pl) by which black ink is ejected per ejection is different from the amount (approximately 5 pl) by which color ink is ejected per ejection. Further, black ink is formulated so that it does not spread much on recording medium, although such formulation requires increase in the amount by which black ink is ejected per ejection, whereas color inks are formulated so that they spread more than black ink (greater in bleeding).

For example, the properties of the black and color inks used in this embodiment are as follows:

black: viscosity: approx. 2 (Pa.s), surface tension, approx. 40 (N/m); and color: viscosity: approx. 2 (Pa.s), surface tension, approx 30 (N/m).

However, the choice of the ink compatible with the present invention is not limited to the ink having the above properties.

In a printing head which employs the above described bubble-jet recording method, the following phenomenon sometimes occurs, the head temperature increase due to the excessive heat from the electrothermal transducers, which in turn increases ink temperature, and the increased ink temperature changes the ink properties (essentially, viscosity), which results in changes in the manner in which ink is ejected. Further, it has been known that, in a low temperature environment, ink viscosity is high, and therefore, ink is difficult to eject. Thus, a few methods for preventing the head temperature change have been known, for example, to control the amount of heat generated by an electrothermal transducer, to provide a printing head with a heating element, and the like. However, the first recording element chip, or the recording element chip for black ink, and the second recording element chip, or the recording element chip for color inks, are different in electrothermal transducer size as well as substrate size, and therefore, the two chips must be controlled differently in terms of the head temperature. This makes the head structure complicated, which is a problem.

However, adhering the first recording element chip, or the recording element chip for black ink, and the second recording element chip, or the recording element chip for color inks, to the same supporting substrate which is high in thermal conductivity, simplifies the heat structure, while keeping the first and second recording element chips virtually the same in substrate temperature.

Incidentally, in order to provide the recording element chips with satisfactory ink drop landing accuracy and initial ejection properties, ejection velocity is desired to be no less than 8 m/sec.

Further, in order to satisfy the aforementioned requirement regarding the amount by which ink is ejected par ejection, and speed at which ink is ejected, the distance OH between an ejection orifice and a recording element is desired to be no more than 100 μm.

Referring to FIG. 9, in the ink jet recording head in this embodiment, the recording element chip H1101, or the recording element chip for color ink, which is of the BTJ type, and the recording element chip H1100, or the recording element chip for black ink, which is of the ordinary BJ type, are mounted on the same plate (first plate H1200). These recording element chips H1100 and H1101 are different in both ink ejection method and ink ejection amount, and therefore, they are different in the energy necessary to drive them. However, they are the same in the voltage of the electrical power supplied thereto. This is due to the fact that providing the recording apparatus main assembly with only one electrical power source for ejection results in low cost.

In the ink jet recording head in this embodiment, in order to make the recording element chips H1100 and H1101 different in the volume by which ink is ejected per ejection, while heating ink to a point of film-boiling in both recording element chips by flowing electrical current to them from the same electrical power source, the length of time (pulse width) electrical current is flowed to the recording element chip H1100 is made different from the pulse width for the recording element chip H1100.

In this embodiment, the driving voltages for the recording element chip for black ink and recording element chip for color inks are both 19 (V). The recording element chip for black ink is 37 μm×37 μm in heater size, and is round in the ejection orifice cross section, which is approximately 25 μm in diameter.

The recording element chip for color inks is 26 μm×26 μm in heater size, and is round in the ejection orifice cross section, which is approximately 16 μm in diameter. The width of the pulse for driving these head, in terms of a single pulse, is approximately 1.4–3.0 μs for the recording element chip for black ink, and approximately 0.6–1.1 μs for the recording element chip for color inks. More specifically, the pulse width is adjusted in accordance with the states of the heater board films, and the number of the heater to be driven, with reference to a pulse table stored in the printer. In order to prepare the table which is read by an ink jet recording apparatus, each ink jet recording head may be measured during the manufacture processes, in resistance value, minimum pulse width necessary for ejection, and the like, to store the obtained values in a ROM with which each recording head is provided. Obviously, the heater resistance value and the like of an ink jet recording head, which are used to adjust the pulse width, may be measured after the ink jet recording head is mounted in an ink jet recording apparatus.

Generally, there is such a correlation between pulse width (pw) and ejection velocity (v) that the shorter the pulse width (pw), the slower the ejection velocity (v).

Therefore, in this embodiment, in order to adjust ejection properties, a double pulse is used. Given below are examples of the double pulse. The first, second, and third numbers for each double pulse in the table represent the durations of pre-pulse, interval, and main pulse, correspondingly. The unit of measurement is microsecond.

| black | | color | |
|---|---|---|---|
| single | double | single | double |
| 1.5 | 0.542-1.583-1.167 | 0.625 | 0.250-0.417-0.500 |
| 2.0 | 0.479-1.146-1.667 | 0.917 | 0.167-0.167-0.833 |
| 2.5 | 0.354-0.688-2.250 | 1.000 | 0.125-0.083-0.958 |

The pulse widths given above are examples, and the present invention is not limited by these examples.

Further, it is possible that when driving a large number of the recording elements H1103 of the recording element chips H1100 and H1101, the amount of the electric current which flows thereto increases, which results in drop in the voltage in the wiring between the recording apparatus main assembly and ink jet recording head. This results in drop in the voltage applied to the recording element chips H1100 and H1101, which in turn reduces the amount by which ink is ejected per ejection. Thus, in this embodiment, in order to prevent the occurrence of such an incidence, the driving pulse width is altered according to the number of the recording elements H1103 to be driven at the same time.

The signals having one of these pulse widths are supplied from the recording apparatus main assembly to the recording element chips H1100 and H1101 through the electrical contact chip H2200 and electric wiring tape H1300 shared by the two recording element chips. The employment of the above described structural arrangement makes it possible to provide a low cost ink jet recording head, in which the recording element chips H1100 and H1101, which are different in driving method, are superbly disposed in terms of space usage efficiency.

Next, the temperatures of the first and second recording element chips H1100 and H 1101 structured as described above when printing is made using the two recording element chips, will be described. When recording was made by only the first recording element chip H1100 at an average duty of 10% (2.2 W), the temperature increase was 4.0° C. for the first recording element chip H1100, and 2° C. for the second recording element chip H1101, whereas when recording was made by only the second recording element chip H1101 at an average duty of 50% (3.5 W), the temperature increase was 4° C. for the first recording element chip H1100, and 6° C. for the second recording element chip H1101, Further, when recording was made with the use of both recording element chips H1100 and H1101, at average duties of 10% (2.2 W) and 50% (3.5 W), respectively, the temperature increase of the first recording element chip H1100 was 7° C., and that for the second recording element chip H1101 was 8° C. As is evident from this result, even when the two chips were made different in the amount of the heat applied thereto, the difference in temperature increase between the two chips was only approximately 2° C. In other words, the two chips remained virtually identical in the manner in which ink was ejected.

Embodiment 2

This second embodiment will be described about only the portions different from those in the first embodiment, with reference to FIGS. 17–18.

Figure 17A:
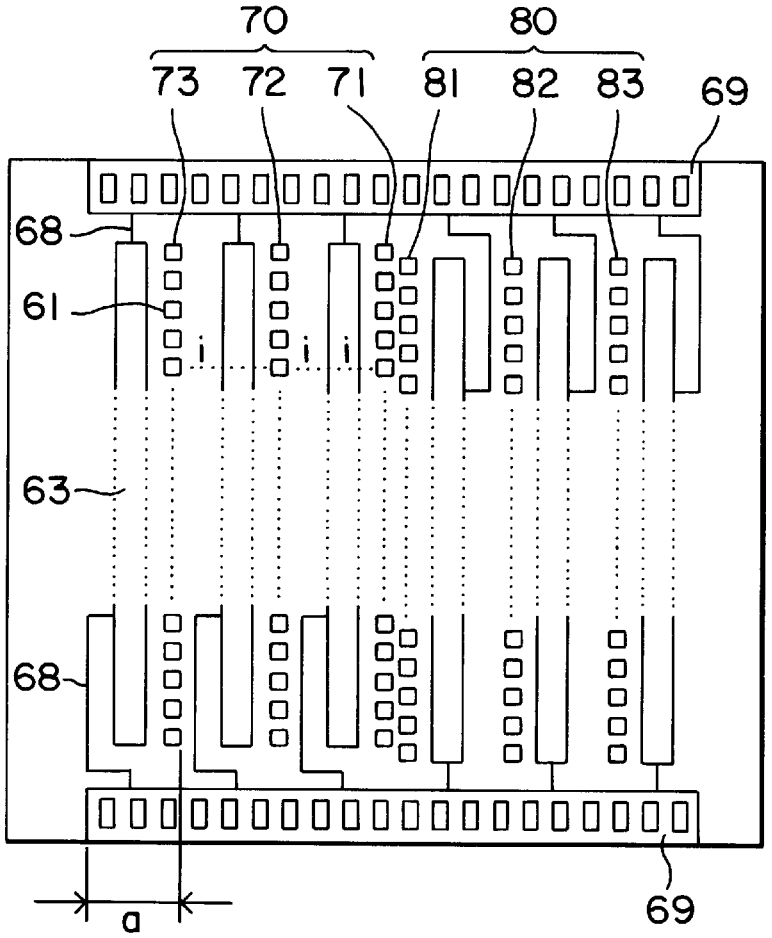
FIGS. 17A, 17B and 17C, is a rough plan of the second recording element chip in the second embodiment of the present invention.
Figure 17B:
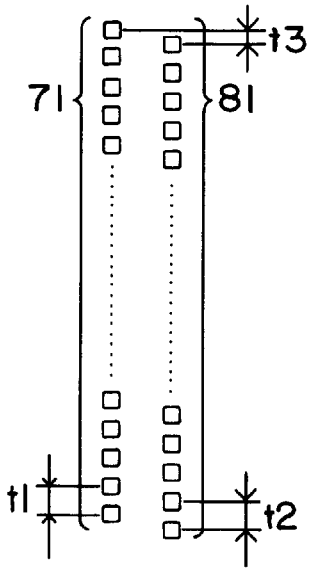
Figure 17C:
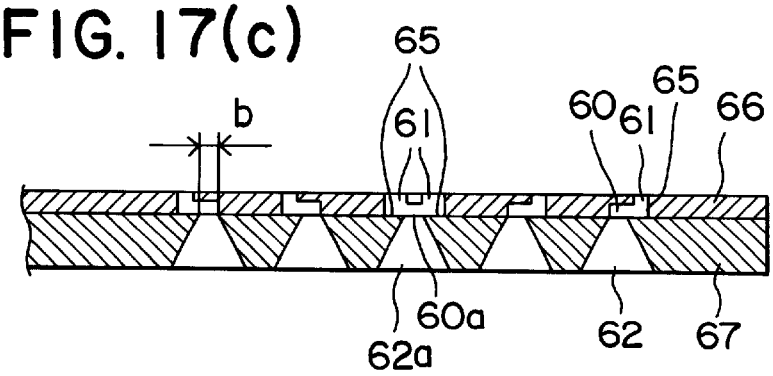
Figure 18:
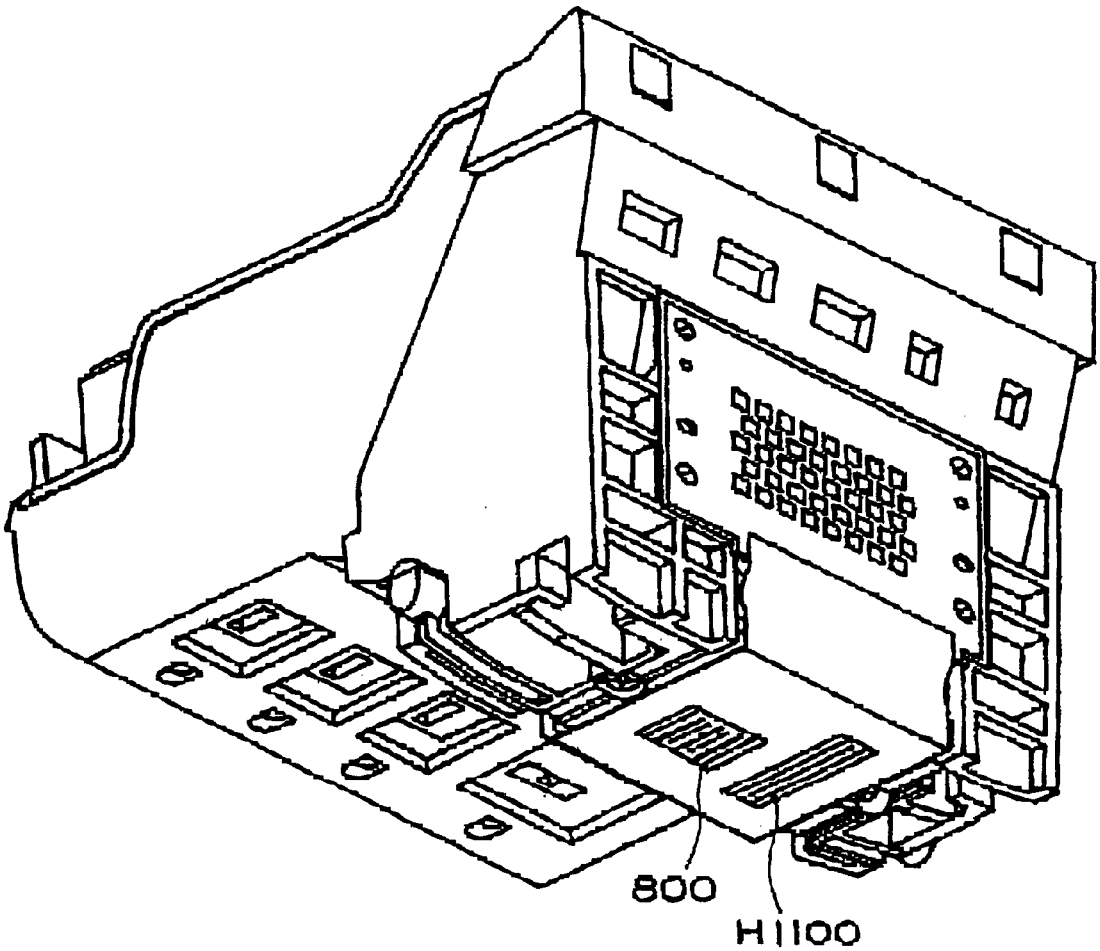
FIG. 18 is a perspective view of a recording head cartridge which employs the second recording element chip in the second embodiment of the present invention.

FIG. 17 shows a modified version of the recording element chip in the first embodiment, wherein FIG. 17(*a*) is a front view and FIG. 17(*b*) is a sectional view. FIG. 18 is a perspective view of an ink jet recording head in which the recording element chips shown in FIG. 17 have been mounted.

Referring to FIG. 17(*c*), the second recording element chip 800, or the recording element chip for color recording, in this embodiment comprise a substrate 67 inclusive of a plurality of electrothermal transducers 65 (recording elements) as energy transducing elements, and an orifice plate 66 which contains a plurality of ejection orifices 61. The substrate 67 is formed of a single crystal of silicon with a plane orientation of <100>. Disposed on the substrate 67 are: a plurality of columns of electrothermal transducers 65; a plurality of driving circuits 63 for driving the electrothermal transducers in each column; a pair of contact pads 69 for external connection, wiring 68 for connecting the driving circuits 63 and contact pads 69; and the like, which are formed with the use of semiconductor manufacturing process. Further, the substrate 67 has five through holes, which have been formed by anisotropic etching through the portions of the substrate 67 on which the aforementioned electrothermal transducers 65, wiring 68, and the like, are not present. These five through holes constitute ink supplying holes 62 and 63*a* for supplying liquid to the ejection orifice columns 71–73 and 81–83, which will be described later. FIG. 17(*a*) is a rough plan of the recording element chip for color inks, in which the substrate 67 is drawn as if the orifice plate 16 covering the substrate 67 is virtually transparent, and the aforementioned heat generating elements and ink supply holes are not shown.

The orifice plate 66 placed on top of the substrate 67 is formed of photosensitive epoxy resin. It is provided with the ejection orifices 61 and liquid paths 60, which are formed with the use of photolithography technologies, and are aligned with the above described electrothermal transducers 65.

The contact pad 69 is connected to the electrode terminals of the electrical wire tape. As external signal input terminals connected to this wiring plate come into contact with the electrical contact portion of a recording apparatus, the recording element chip 800 is enabled to receive driving signals or the like from the recording apparatus. The ink supplying holes 62 and 62*a*, and the like are connected to the corresponding ink containers through the ink flow paths of the flow path formation member H1600 of an ink supplying unit.

Further in this embodiment, a plurality of election orifices 61 are provided, which are aligned in a plurality of straight columns, forming ejection orifice columns (ejection portions) 71–73 and 81–83, which are parallel to each other, and in which a predetermined number of ejection orifices 61 are placed at a predetermined interval. In FIG. 17(*a*), the i-th ejection orifices in the ejection lines 71–73 align straight in the direction indicated by an arrow mark in FIG. 17(*a*). In other words, the i-th ejection orifices in the ejection lines 71–73 are positioned so that they align in the direction in which the recording head cartridge is moved in the scanning manner after being mounted into the recording apparatus or the like. The ejection orifice columns 71–73 together constitute a first ejection orifice column group 70. The same is true of the ejection orifice columns 81–83, and the ejection orifice columns 81–83 together constitute a second ejection orifice column group 80, which is located immediately adjacent to the first ejection orifice column group 70.

The substrate of the second recording element chip 800 is provided with five ink supplying holes. Counting from the left side in FIG. 17, a single ejection orifice column for cyan ink is on outward side of the first ink supplying hole; a single ejection orifice column for magenta ink, on the outward side of the second ink supplying hole: two ejection orifice columns for yellow ink sandwich the third ink supplying holes; a single ejection orifice column for magenta ink, on the outward side of the fourth ink supplying hole, and a single ejection orifice column for cyan ink is on the outward side of the fifth ink supplying hole. In each ejection orifice column, the ejection orifices are aligned at an interval equivalent to a resolution of 600 dpi, and the two ejection orifice column groups 70 and 80 are displaced relative to each other, in terms of the direction parallel to the ejection orifice columns, by a distance equal to half the interval between two ejection orifices in the same column, enabling the recording element chip 800 to print at a resolution of 1200 dpi.

In other words, the outermost ejection orifice columns, with respect to the center line of the recording element chip in terms or its scanning movement direction, that is, the ejection orifice columns 73 and 83, eject cyan (C) ink, and the ejection orifice columns 72 and 82 eject magenta (M) ink; and the most inward ejection orifice columns, that is, the ejection orifice columns 71 and 81, which are immediately adjacent to each other, eject yellow (Y) ink. Thus, to the ink supplying hole 62*a* (ink supply hole located at the center), yellow ink is supplied from an ink container dedicated to yellow ink, and to the two ink supplying holes 62 sandwiching the ink supplying hole 62*a*, magenta ink is supplied from an ink container dedicated to magenta ink, To the most outward two ink supplying holes 62, cyan ink is supplied from an ink container dedicated to cyan ink. As is evident from the above description, the central ink supplying hole 12*a* supplies ink to two ejection orifice columns 71 and 81, and the ink supplying hole 62*a* and liquid path 60*a* function as a common liquid chamber for the ejection orifice columns 71 and 81 positioning the two ejection orifice columns, which are different in the ejection orifice column group they belong, but are th same in the type of liquid they eject, at the center of the recording element, and virtually symmetrically positioning the rest of the ejection orifice columns, which are also different in term of the ejection orifice column group, but are the same in ink color, and the driving circuits therefor, with respect to the center portion of the recording element, makes it possible to position the through holes as the ink supply holes 62 and 62*a*, driving circuits, electrothermal transducers, and the like, on the substrate, at an even interval and without spatial waste, and therefore, making it possible to reduce the substrate size.

Further, symmetrically positioning the two ejection orifice columns, which are the same in the color of the liquid they eject, with respect to the center line of the recording element chip, makes the same, the order in which ink droplets different in color are placed in each picture element to generate an intended color on recording medium when the recording element is moved in a manner to scan the recording medium in one direction, as when the recording element is moved in the other direction, and therefore, making the picture elements uniform in color development regardless of the direction of the scanning movement of the recording element chips, and therefore, preventing the picture elements from becoming nonuniform in color development due to the switching of the scanning movement direction of the recording element chip during two way printing (two direction printing).

Further, as is evident from FIGS. 17(*a*) and 17(*b*), the first and second ejection orifice column groups 70 and 80 are slightly displaced from each other in terms of the second scanning movement direction of the recording head, by a distance equivalent to half the pitch at which the ejection orifices are aligned in each column, so that the ejection orifices in the ejection orifice columns 71–73, which together constitute the ejection orifice column group 70, and the ejection orifices in the ejection orifice columns 81–83, which together constitute the ejection orifice column group 80, compensate for each other in terms of the above described primary scanning movement direction of the recording head. With this ejection orifice placement, it is possible to print in a highly precise mode, that is, practically, at a resolution equivalent to twice the ejection orifice alignment pitch in each ejection orifice column.

Further, in the second recording element chip 800, the density at which the electrothermal transducers 65 are aligned is set to a value equivalent to a resolution of 1200 dpi, and the amount by which color liquid is ejected per ejection is set to 4–8 pl. On the other hand, in the first recording element chip H1100, which was described in the first embodiment, the electrothermal transducer alignment density is set to a value equivalent to a resolution of 600 dpi, and the liquid ejection amount is set to 20–40 pl.

Thus, the size of each electrothermal transducer 65 of the second recordinlg element chip 800 is smaller than that of the first recording element chip H1100, or the recording element chip for black ink, and also, the size of each ejection orifice 61 of the second recording element chip 800 is smaller than that of the first recording element chip H100. For example, in order to realize a liquid droplet size of 30 pl for black ink, the distance OH between an ejection orifice and an electrothermal transducer and the ejection orifice cross section SO, in the first recording element chip H1100, must be 70–80 $\mu$m and 600–800 $\mu$m2, respectively. On the other hand, in order to realize a liquid droplet size of 5 pl for color ink, the OH and SO for the second recording element chip 800 must be 25 $\mu$m and 200 $\mu$m2 respectively. These requirements are the same as those in the first embodiment.

In this embodiment, the recording head cartridge (FIG. 18) having a structural arrangement similar to that described regarding the first embodiment was assembled by fixing the second recording element chip 800 structured as described above, and the first recording element chip H1100 identical to that described regarding the first embodiment, to the first plate H1300 with the use of adhesive.

Further, the density at which the electrothermal transducers are aligned in the second recording element chip 800, or the recording element chip for color inks, was made twice that in the first recording element chip H1100 (for example, the electrothermal transducer densities in the first and second recording element chips H1100 and 800 were set to values equivalent to resolutions of 600 dpi and 1200 dpi, respectively), and even after the recording head was driven for 16 hours at 25 kHz, it was possible to maintain a heating pulse width of approximately 2.5 ps. In comparison to the ordinary pulse width, even when compensation was made for the variance in the electrothermal transducer resistance value resulting from manufacture error, and voltage drop caused by ejection current, the pulse width could be kept at approximately 2 ps, and the recording element chips could be used trouble free up to 109 pulses. In comparison, if the electrothermal transducer density in the second recording element chip 800 was made the same as that in the first recording element chip H1100, a driving frequency of 50 kHz was necessary, and the pulse width had to be reduced to 1.25 $\mu$s or less, in order to realize the same recording speed. In this case, the aforementioned adjustment of the pulse width was not sufficient for satisfactory compensation, and therefore, it was necessary to increase voltage. As a result, the electrothermal transducers became damaged after 107 pulses, in spite of the fact that the recording element chip 800 needs twice the number of pulses which the recording element chip for black ink needs to fill a given area.

Incidentally, the temperature of the recording element chips is more likely to change when printing is made bidirectionally. In this embodiment, when printing was made bidirectionally, the temperatures of the first and second recording element chips H1100 and 800 changed as follows.

More specifically, when recording was made by only the second recording element chip 800, at an average duty of 50% (3.5 W), the temperature increase was 3° C. for the first recording element chip H1100, and 5° C. for the second recording element chip 800. Further, when recording was made with the use of only the second recording element chip 800, at average duties of 100% (7.0 W), the temperature increase of the first recording element chip H1100 was 80C, and that for the second recording element chip 800 was 10° C. As is evident from this result, even under a severe operational conditions such as when printing was made bidirectionally, the difference in temperature increase between the two chips could be kept very small; in other words, the preferable ejection condition could be maintained.

Also in this embodiment, the height of the recording element chip H1100, that is, the distance between the surface of the recording element chip H1100, which is provided with the ejection orifices, and the referential surface, that is, the back surface of the first plate H1200, is different from that of the recording element Chip 800. In other words, the position of the surface of the recording element chip H1100, or the recording element chip for monochromatic recording, which is provided with the ejection orifices, with reference to the referential surface, is higher than that of the second recording element chip 800, or the recording element chip for color recording. (Ink Jet Recording Apparatus)

Figure 19:
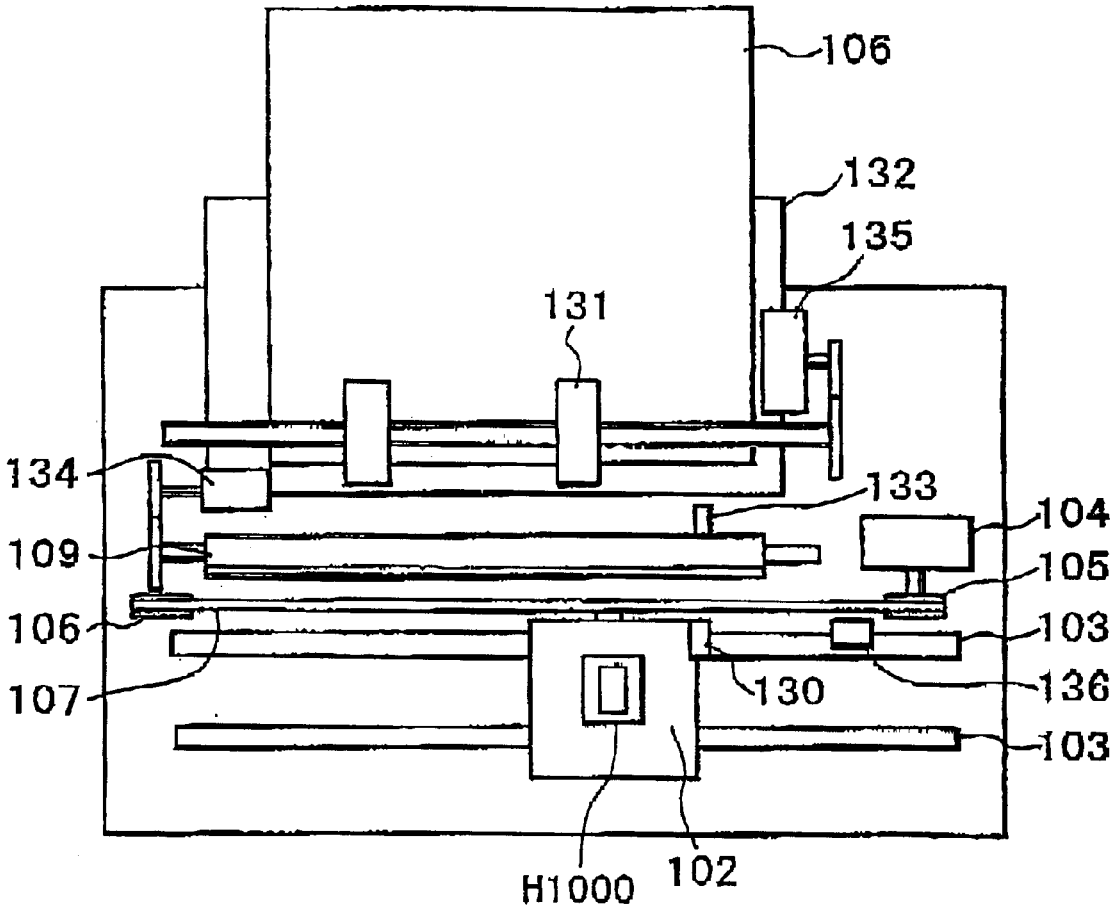
FIG. 19 is a rough plan of an example of a recording apparatus in which a liquid ejection recording head in accordance with the present invention is mountable.

Lastly, an example of a liquid ejection recording apparatus in which a cartridge type recording head such as the one described above is mountable will be described. FIG. 19 is a rough plan of an example of a recording apparatus in which a liquid ejection recording head in accordance with the present invention is mountable.

In the recording apparatus shown in FIG. 19, the recording head cartridge H1000 shown in FIG. 1 has been exchangeably mounted on a carriage 102, being accurately positioned relative to the carriage 102. The carriage 102 is provided with an electrical contact portion for transmitting driving signals and the like to each ejection orifice portion through the external signal input terminals on the recording head cartridge H1000.

The carrier 102 is supported and guided by a guiding shaft 103, with which the recording apparatus main assembly is provided and which extends in the primary scanning movement direction. The carriage 102 is driven by a primary scan motor 104, through a drive train comprising a motor pulley 105, a follower pulley 106, a timing belt 107, and the like, while being controlled in position and movement. Further, the carriage 102 is provided with a home position sensor 130, which makes it possible to detect the position of the carriage 102 as the home position sensor 130 passes the position of a shield plate 136. A plurality of sheets of recording medium 108, for example, printing paper or thin plastic plate, placed in an automatic sheet feeder 132 (which hereinafter will be referred to as ASF) are fed into the apparatus main assembly one by one while being separated from the rest of the sheets of the recording medium 108 in th ASF, by rotating a pickup roller 131 by a sheet feeder motor 135 through gears. Each sheet of recording medium 108 is further conveyed (in the secondary scan direction) through a portion (printing portion) at which it opposes the surface of the recording head cartridge H1000, which is provided with the ejection orifices, by the rotation of a pair of conveying rollers 109, which is rotated by an LF motor 134 through gears. Whether or not a sheet of recording medium 108 has been fed into the apparatus main assembly, and the accurate position of the leading end of the recording medium 108, are determined as the recording medium 108 passes a paper end sensor 133. The paper end sensor 133 is also used for determining the actual position of the trailing end of the recording medium 108, and also for ultimately determining the current recording position based on the actual position of the trailing end of the recording medium 108.

The recording medium 108 is supported from the backside by a platen (unshown) so that the recording medium 108 provides a flat printing surface.

On the other hand, the recording head cartridge H1000 is mounted on the carriage 102 in such a manner that the recording head cartridge surface with the ejection orifices projects downward from the carriage 102, and becomes parallel to the recording medium 108, in the area between the aforementioned two pairs of conveying rollers.

Further, the head cartridge H1000 is mounted on the carriage 102 so that the direction of each ejection orifice column becomes perpendicular to the aforementioned direction of the primary scanning movement of the carriage 102, and recording is made by ejecting liquid from these ejection orifice columns.

According to the present invention, an ink jet recording head is provided with a plurality of recording element chips, which are different in the distance between a recording element and an ejection orifice. Therefore, it is possible to eject recording liquid by various amounts with the use of various ejection methods, without preparing a plurality of ink jet recording heads, Therefore, black ink can be formed into a relatively large ink droplet while forming color ink into a relatively smaller ink droplet. As a result, it is possible to increase the speed at which recording is made by black ink while improving quality level at which recording is made by color inks. In addition the present invention simplifies the ink jet recording head structure, being therefore not likely to cause the ink jet recording head to increase in size.

Therefore, the present invention can reduce the ink jet recording head manufacturing cost.

While the invention has been described with reference to the structures disclosed herein, it is not confined to the details set forth, and this application is intended to cover such modifications or changes as may come within the purposes of the improvements or the scope of the following claims.

What is claimed is:

1. An ink jet recording head comprising:

a plurality of recording element substrates each having a plurality of recording elements for applying ejection energy to a recording liquid;

a plurality of flow paths for the recording liquid for receiving ejection energy;

a supply port for supplying the recording liquid to the plurality of flow paths;

a plurality of ejection outlets for ejecting the recording liquid, said ejection outlets being disposed in front of the recording elements;

wherein distances between the recording elements and the ejection outlets in at least one of said recording element substrates are different from distances between the recording elements and ejection outlets of another one of said recording element substrates, and wherein liquid ejection systems of the recording elements of at least one of said recording element substrates and the recording elements of said another one of said recording element substrates, are different.

2. An ink jet recording head according to claim 1, wherein the distances between said recording elements and said ejection outlets in said at least one of said recording element substrates to which blackish liquid is supplied is longer than the distances between said recording elements and said ejection outlets in said another one of said recording element substrates to which chromatic liquid is supplied.

3. An ink jet recording head according to claim 2, wherein liquid ejection amounts from said ejection outlets in said at least one of said recording element substrates to which blackish liquid is supplied is larger than the liquid ejection amounts from said ejection outlets in said another one of said recording element substrates to which chromatic liquid is supplied.

4. An ink jet recording head according to claim 3, wherein a density of arrangement of said recording elements in said recording element substrates to which the chromatic liquid is supplied is approximately two times the density of arrangement of said recording elements in said recording elements substrates to which the blackish liquid is supplied.

5. An ink jet recording head according to claim 4, wherein the plurality of the recording element substrates are provided in one base member.

6. An ink jet recording head according to claim 5, wherein said base member has a thermal expansion coefficient and a thermal conductivity which are substantially the same as those of said at least one of said substrates, respectively, and those of said another one of said substrates, respectively.

7. An ink jet recording head according to claim 3, wherein a liquid ejection speed VBk and a liquid ejection amount V-dBk through said ejection outlets in said at least one of said recording element substrates, and a liquid ejection speed VCl and a liquid ejection amount V dCl through said ejection outlets in said another one of said recording element substrates, satisfy;

$$vCl>VBk\geqq 8\ m/sec,$$

and $$vdBk>V\ dCl.$$

8. An ink jet recording head according to claim 2, wherein the liquid ejection system of the recording elements of said at least one of said recording element substrates is such that bubbles are generated in the recording liquid by actuation of said recording elements, and the bubbles are collapsed, and the liquid ejection system of the recording elements of the recording elements of said another one of said recording element substrates is such that bubbles are generated in the recording liquid by actuation of said recording elements, and the bubbles are brought into communication with an ambient environment.

9. An ink jet recording head according to claim 2, wherein the distances 0 HBk between said recording elements and said ejection outlets and distances hBk between said recording elements and said ejection outlet forming member in said at least one of said recording element substrates, and the distances OHCl between said recording elements and said ejection outlets and distances hCl between said recording elements and said ejection outlet forming member in said another one of said recording element substrates, satisfy;

hBk>h Cl, and oHBk>hBk×2.

10. An ink jet recording head according to any one of claims 1–9, further comprising a plurality of ink containers for supplying the recording liquids to said ink jet recording head and to said recording element substrates.

11. An ink jet recording head according to claim 10, wherein said recording elements are supplied with electric energy from one voltage source.

12. An ink jet recording head according to claim 1, wherein said recording element substrates have base plates having substantially the same thicknesses and placed on one flat surface and have ejection outlet forming members laminated on the base plates, and wherein said at least one of said recording element substrates have different heights of the ejection outlet forming member, by which the distances between said recording elements and said ejection outlets are different from the distances between said recording elements and said ejection outlets in said another one of said recording element substrates.

13. An ink jet recording head according to claim 1, wherein said recording element substrates have base plates having substantially the same thicknesses and placed on one flat surface and have ejection outlet forming members laminated on the base plates, and wherein said ejection outlets are formed by photo-patterning.

14. An ink jet recording head according to claim 13, wherein the distances between said recording elements and said ejection outlets in said at least one of said recording element substrates are not more than 100 $\mu$m.

* * * * *

UNITED STATES PATENT AND TRADEMARK OFFICE

CERTIFICATE OF CORRECTION

PATENT NO. : 6,481,819 B2
DATED : November 19, 2002
INVENTOR(S) : Mineo Kaneko et al.

It is certified that error appears in the above-identified patent and that said Letters Patent is hereby corrected as shown below:

Column 1,
Line 10, “relate” should read -- relates --.

Column 2,
Line 34, “a droplet” should read -- droplet --; and
Line 37, “methods,” should read -- method, --.

Column 3,
Line 40, “studies” should read -- studied --.

Column 4,
Line 9, “face” should read -- faced --; and
Line 34, “Two” should read -- two --.

Column 5,
Line 56, “invention” should read -- invention. --.

Column 6,
Line 7, “enlarge,” should read -- enlarged, --.

Column 7,
Line 27, “chip H1001” should read -- chip H1101, --.

Column 8,
Line 33, “H1103” should read -- H1103, --.

Column 9,
Line 11, “(A12O3)” should read -- ($A1_2O_3$) --; and
Line 20, “(Si3N4),” should read -- ($Si_3N_4$), --.

Column 10,
Line 7, “(A12O3)” should read -- ($A1_2O_3$) --; and
Lines 37 and 50, “an” should read -- on --.

Column 11,
Line 35, “th” should read -- the --;
Line 45, “H100” should read -- H1003 --; and
Line 67, “H101,” should read -- H1101, --.

Column 12,
Line 31, “has” should read -- have --.

UNITED STATES PATENT AND TRADEMARK OFFICE

CERTIFICATE OF CORRECTION

PATENT NO. : 6,481,819 B2
DATED : November 19, 2002
INVENTOR(S) : Mineo Kaneko et al.

It is certified that error appears in the above-identified patent and that said Letters Patent is hereby corrected as shown below:

Column 13,
Line 8, “employs,” should read -- employed --.

Column 15,
Lines 30 and 39, “is” should read -- are --.

Column 16,
Line 49, “contains” should read -- contain --.

Column 18,
Line 4, “Of” should read -- of --; and
Line 50, “holes” should read -- hole --.

Column 19,
Line 1, “H1101” (first occurrence) should read -- H1100 --;
Line 2, “stared” should read -- shared --; and
Line 34, “ink” should read -- ink. --.

Column 20,
Line 21, “spit” should read -- spite --; and
Line 32, “approx” should read -- approx. --.

Column 21,
Line 2, “par” should read -- per --.

Column 24,
Line 34, “th” should read -- the --.

Column 26,
Line 26, “Chip” should read -- chip --; and
Line 32, “(Ink” should read -- ¶(Ink --.

Column 28,
Line 11, “is longer” should read -- are longer --;
Line 18, “is larger” should read -- are larger --;
Line 27, “elements” should read -- element --; and
Line 42, “satisfy;” should read -- satisfy: --.

UNITED STATES PATENT AND TRADEMARK OFFICE

CERTIFICATE OF CORRECTION

PATENT NO. : 6,481,819 B2 
DATED : November 19, 2002
INVENTOR(S) : Mineo Kaneko et al.

It is certified that error appears in the above-identified patent and that said Letters Patent is hereby corrected as shown below:

Column 29,
Line 3, "satisfy;" should read -- satisfy: --; and
Line 13, "claims 1-9," should read -- claims 1-9 and 12-14, --.

Signed and Sealed this

Nineteenth Day of August, 2003

JAMES E. ROGAN
*Director of the United States Patent and Trademark Office*